US007625148B2

(12) United States Patent
Marra, III et al.

(10) Patent No.: US 7,625,148 B2
(45) Date of Patent: Dec. 1, 2009

(54) TROUGH SUPPORT RIBS AND METHOD OF USE

(75) Inventors: Michael Anthony Marra, III, Lexington, KY (US); Randall David Mayo, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 122 days.

(21) Appl. No.: 11/457,225

(22) Filed: Jul. 13, 2006

(65) Prior Publication Data

US 2007/0183833 A1 Aug. 9, 2007

Related U.S. Application Data

(63) Continuation-in-part of application No. 11/329,760, filed on Jan. 11, 2006.

(51) Int. Cl.
*B41J 2/01* (2006.01)
*B41J 2/185* (2006.01)

(52) U.S. Cl. ..... 400/648; 347/1; 347/104

(58) Field of Classification Search ..... 347/1, 347/20, 22, 34, 35, 36, 101, 104, 105; 400/648, 400/656

See application file for complete search history.

(56) References Cited

U.S. PATENT DOCUMENTS 5,844,585 A * 12/1998 Kurashima et al. ..... 347/43
6,616,266 B2 9/2003 Neal et al.
6,796,648 B2 9/2004 Ohashi
6,817,696 B2 11/2004 Miki et al.
6,820,962 B2 11/2004 Uchida
6,840,617 B2 1/2005 Crosby et al.
6,860,583 B2 3/2005 Cheney et al.
6,866,361 B2 3/2005 Kuki et al.
6,964,466 B1 * 11/2005 Kodama et al. ..... 347/36

FOREIGN PATENT DOCUMENTS

JP 2006001140 A * 1/2006

OTHER PUBLICATIONS

Hewlett Packard Printer—drawing attached.

* cited by examiner

*Primary Examiner*—Daniel J Colilla
*Assistant Examiner*—Wyn' Q Ha
(74) *Attorney, Agent, or Firm*—Middleton Ruetlinger

(57) ABSTRACT

An improved method of edge-to-edge printing on media in a printer having a printhead disposed above an ink trough, the ink trough has a plurality of sections formed by a plurality of trough support ribs within the ink trough, comprises indexing a leading edge of media to a first position over a first trough section, selectively operating printhead jets which are positioned above the media to inhibit ink contamination of exposed support ribs, indexing the media leading edge to one of a second position within the first trough section or a position within a second trough section.

22 Claims, 19 Drawing Sheets

TROUGH SUPPORT RIBS AND METHOD OF USE

CROSS REFERENCES TO RELATED APPLICATIONS

The present application is a continuation-in-part of U.S. patent application Ser. No. 11/329,760, filed Jan. 11, 2006, entitled "TROUGH SUPPORT RIBS" and assigned to the assignee of this application.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to media support structures, and more particularly to a media support structures which improve edge-to-edge printing.

2. Description of the Related Art

Digital photo printing has increased in popularity in recent years due to the increased popularity of digital cameras. Generally, digital cameras convert an optical image to a digital image through a charge-coupled device (CCD) image sensor or the like. The digital image may then be saved to an image memory for further data processing. In recent years digital camera features have improved significantly. For example, digital camera resolutions and memory storage capabilities have increased while prices for such features have steadily decreased, leading to increased digital camera sales. As a result of increased use of digital cameras, edge-to-edge photo printing has increased. Users desire developed pictures having the look, feel and size of photos developed by professional developers.

Manufacturers have developed various photo printers which print the digital images to media comparable to professionally developed photos. Current manufacturers have primarily utilized inkjet technology in order to obtain high quality photo prints. In conventional inkjet printers, there may be a carriage having one or more ink cartridges removably mounted therein. Each cartridge may utilize a printhead for directing ink to a media sheet passing adjacent thereto. The carriage unit is adapted to sweep the ink cartridge in a path of travel adjacent to the media, which is typically moved in a transverse or orthogonal direction to the carriage unit. As the printhead sweeps or scans adjacent the media, ink droplets are ejected onto the medium sheet which is typically supported from below by a platen.

In conventional inkjet printing, manufacturers have strived to avoid ink smearing on the underside of a media sheet. Smearing may occur when ink is misdirected onto printer components adjacent the feedpath and the media touches such component. One way of avoiding ink on the printer components is to form margins. Accordingly, conventional printers inhibit ejection of ink onto the leading, trailing, and side edges of the medium sheet. This creates sheet margins, and in turn, protects the upper surface of the supporting platen from receiving ink droplets being ejected by the printhead. However, the advent of photo printing has led to a desire to print borderless images, which appear similar to professionally developed photographs.

Manufacturers have encountered difficulty in providing a detailed photo image up to the media edge, also known as edge-to-edge printing. As media leading edges and trailing edges pass through a print zone, the media tends to sag or bend, resulting in changing of the distance between the printhead and media making edge printing difficult. One manufacturer has employed the use of a trough filled with an absorbing foam for the sprayed ink. Projecting through the foam and extending from the bottom of the trough and centered between the two walls of the through is single row of a plurality of narrow column-like structures, each having a relatively broad rounded-over top. The column tops extend above the top of the foam and support the underside of the media during its travel through the print zone. One drawback with this approach is the width of the supports. The relatively large area of the support becomes an area where the sprayed ink can accumulate and possibly smudge the undersurface of the media. Also a large number of support columns are used along the length of the through increasing the chances of ink accumulation and smudging.

To ensure that there are no blank areas along the media edges and to compensate for positional errors, the printhead must also fire ink from nozzles which are slightly beyond the edge of the media. Thus, the printed area will include the edges of the media and eliminate blank areas therealong. However, since the media must be oversprayed to ensure printed ink along the edges, ink ejected from the nozzles spreads to areas where media does not exist and may adhere to the printer components generally adjacent the print zone, such as the platen or ribs. When a subsequent medium passes through this area, ink may be smudged on a surface of the media facing the platen or ribs.

Another difficulty which printer manufacturers have struggles with is maintaining a constant distance between the printhead and the media. This causes a change in distance between the printhead and the media being printed on and further results in decreased print quality especially along media edges. It is preferable that a gap between the nozzles of the printhead and the media must always be maintained constant since any change in distance may adversely affect photo print quality. However, due to the water content of ink, the media is subject to a phenomenon known as "cockle" consisting of swelling and expansion of the media during printing. When cockle occurs, the media forms bubbles and wrinkles and, as a result, the distance between the paper and printhead decreases in some areas. As a result, the distance between the printhead and media changes. The cockling of the media may also result in "vertical banding" because the bubble in the media may cause the ink dots to fall in positions offset from their correct position, e.g. all displaced toward the same side, leaving visible marks on the media in the form of parallel lines. These issues also increase the difficulty of edge-to-edge printing.

Given the foregoing, it will be appreciated that a method is needed which utilizes media supports while printing in a manner which does not contaminate the media supports and subsequently contaminate the media, but which also forms a complete image along the media leading and trailing edges for edge-to-edge printing.

SUMMARY OF THE INVENTION

The present invention improves edge-to-edge printing by providing an improved method for use with improved support structures while inhibiting contamination of media with overspray ink.

According to a first aspect, an improved method of edge-to-edge printing of media in a printer having a printhead disposed above an ink trough, the ink trough has a plurality of sections formed by a plurality of trough support ribs within the ink trough, comprises indexing a leading edge of media to a first position over a first trough section, selectively operating printhead jets which are positioned above the media to inhibit ink contamination of exposed support ribs, indexing the media leading edge to one of a second position within the first trough section or a position within a second trough section. The method further comprises indexing the media leading edge to each of the plurality of sections. The method further comprises indexing a trailing edge of the media to at least one position within the plurality of sections. The method further comprises indexing the media leading edge to at least two positions within each of the trough sections. The method further comprises increasing the number of active printhead nozzles through each subsequent indexing of the media leading edge through each of said trough sections. The method further comprises decreasing the number of active printhead nozzles as a media trailing edge is indexed through each of the trough sections. The method further comprises indexing a trailing edge of the media through two positions within each of the trough sections. The method further comprises indexing a large move to each of the trough sections and a small move within each of the trough sections. The method further comprises indexing steps of substantially equivalent distance when the leading edge is beyond a final of the plurality of trough sections and the trailing edge has not reached an end of form sensor.

According to a second aspect, a method for improving edge-to-edge printing of media in a printer having a printhead disposed above an ink trough, said ink trough having a plurality subtroughs formed by a plurality of support ribs within said ink trough comprises indexing a media leading edge to a first nominally aligned position, performing a printhead pass, selectively operating ink nozzles corresponding to a first subtrough and upstream thereof, indexing the leading edge to one of at least one additional subtrough, performing a printhead pass, selectively operating the ink nozzles corresponding to the at least one additional subtrough and upstream thereof to form an image along at least the media edge, signaling a print controller when a trailing edge of the media is detected, determining whether an adjustment move is needed to position the trailing edge in a nominally aligned position, making one or more adjustment moves to nominally align the trailing edge in a first subtrough, indexing the trailing edge to one of a second position in the first subtrough or at least one additional subtrough. The plurality of subtroughs may comprise four subtroughs. The method further comprises indexing the media to at least two positions within each of the plurality of subtroughs. The method further comprises indexing the media at least one large move between each of the plurality of subtroughs and at least one small move within each of the plurality of subtroughs. The method further comprises increasing the number of active printhead nozzles as the leading edge of the media advances along the trough and decreasing the number of active printhead nozzles as the trailing edge of the media advances along the trough.

According to a third aspect, a method for improving edge-to-edge printing in a printer including a printhead transversely movable over an ink trough having a plurality of subtroughs therein comprises indexing media leading edge to a first position at each of the plurality of subtroughs, forming an image along a leading edge of the media at each of the plurality of subtroughs, indexing the media leading edge to at least a second position within each of the plurality of subtroughs, forming an image along the leading edge of the media at each of the at least second position, indexing a trailing edge to a first position at each of the plurality of subtroughs, forming an image along the trailing edge of the media at each of the plurality of subtroughs; indexing the media trailing edge to at least a second position within each of the plurality of subtroughs, forming an image along the trailing edge of said media at each of said at least second position. The method further comprises increasing the number of active printhead nozzles as the leading edge of the media advances along said trough and decreasing the number of active printhead nozzles as the trailing edge of the media advances along said trough. The method further comprises indexing the media at substantially equivalent increments when the leading edge of the media is beyond a final subtrough and before the trailing edge of the media reaches an end-of-form sensor upstream of a first subtrough. The indexing from each of said plurality of subtroughs comprises a large move and the indexing within each of said plurality of subtroughs comprises a small move. The method further comprises performing at least three small moves within each of said plurality of subtroughs.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
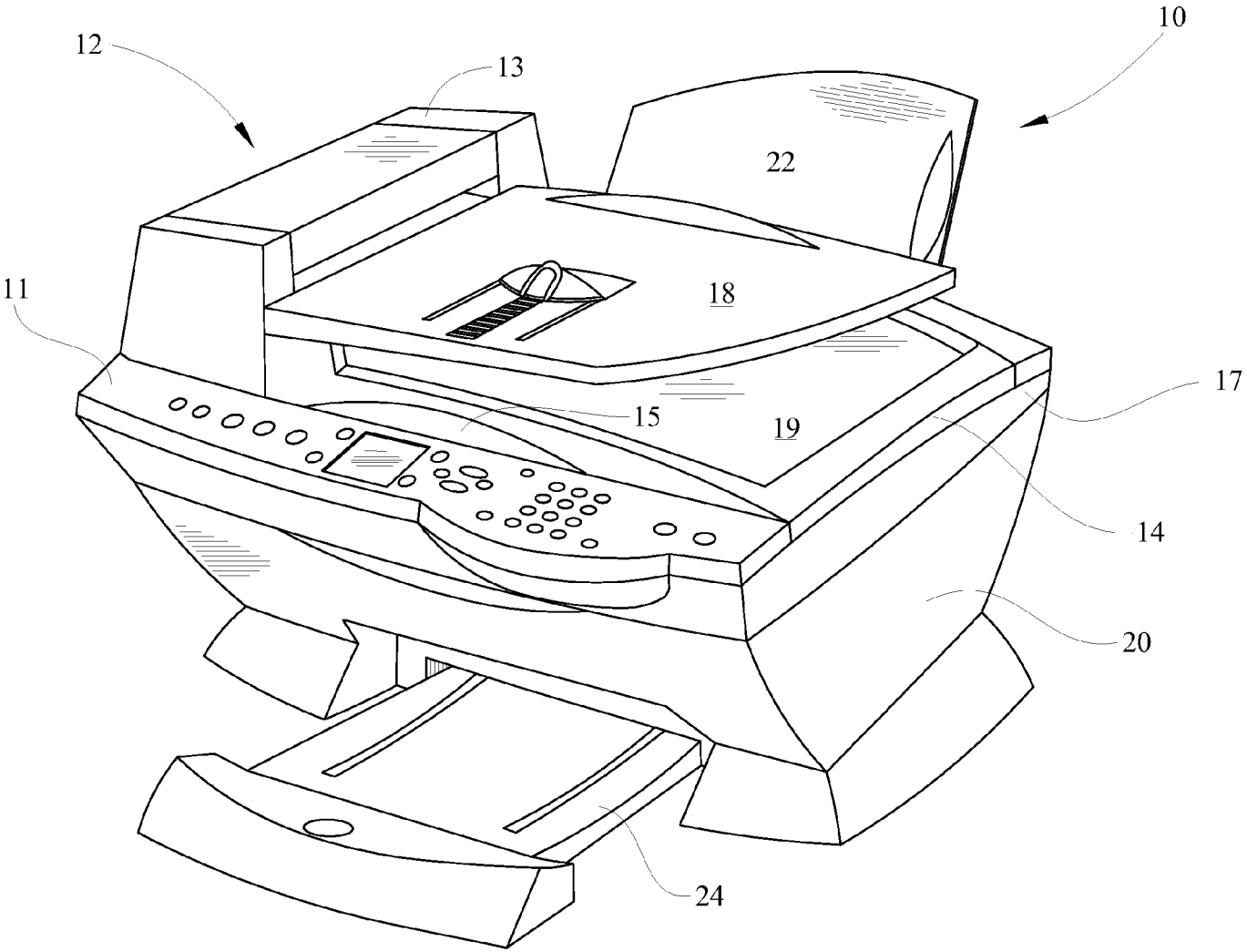
FIG. 1 is a perspective view of an all-in-one device including a printing component.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and all-in-one devices that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output.

Referring now in detail to the drawings, wherein like numerals indicate like elements throughout the several views, there are shown in FIGS. 1-14 various aspects of trough support ribs. The apparatus provides trough ribs for supporting media spanning the ink trough, improving edge-to-edge printing as well as minimizing contact with the media. The ribs further enhance movement of ink overspray to an ink trough.

Referring initially to FIG. 1, an all-in-one device 10 is shown having an ADF scanner portion 12 and a printer portion 20, depicted generally by the housing. The all-in-one device 10 is shown and described herein, however one of ordinary skill in the art will understand upon reading of the instant specification that the present invention may be utilized with a stand alone printer, copier, or other printing device utilizing a media feed system. The peripheral device 10 further comprises a control panel 11 having a plurality of buttons for making selections. The control panel 11 may include a graphics display to provide a user with menus, choices or errors occuring with the system.

Still referring to FIG. 1, extending from the printer portion 20 is an input tray 22 at the rear of the device 10 and an exit tray 24 extending from the front of the device 10 for retaining media before and after a print process, respectively. A media feedpath 21 (FIG. 2) extends between the input tray 22 and output tray 24. The printer portion 20 may include various types of printing mechanisms including a dye-sublimation or an ink-jet printing mechanism. For ease of description, the exemplary printer portion 20 is an inkjet printing device.

Figure 2:
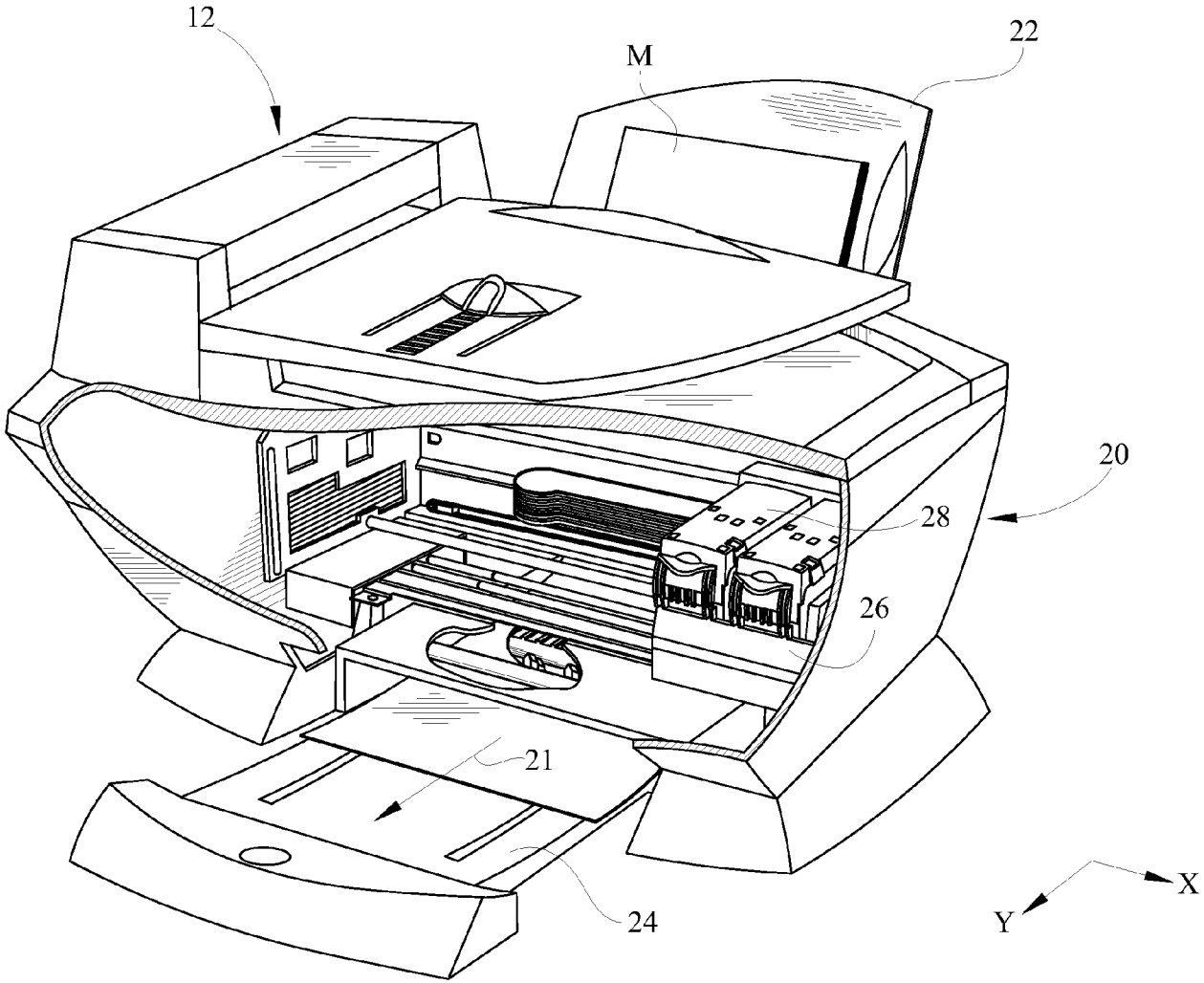
FIG. 2 is a perspective view of the all-in-one device of FIG. 1 with a cut-away section depicting the printing components.

Referring now to FIG. 2, an interior cut-away perspective view of the all-in-one device 10 is depicted. With the interior shown, the printing portion 20 includes a carriage 26 having a position for placement of at least one print cartridge 28. FIG. 2 depicts two print cartridges 28 which may be, for instance, a color cartridge for photos and a black cartridge for text and or color printing. Also two color cartridges may also be used. As one skilled in the art will recognize, the color cartridge may include three ink, i.e., cyan, magenta and yellow inks. The second color cartridge, if used, would contain more dilute versions of these three colors. Alternatively, in lower cost machines, a single cartridge may be utilized wherein the three ink, i.e., cyan, magenta and yellow inks are simultaneously utilized to provide the black for text printing or for photo printing. During advancement media moves from the input tray 22 to the output tray 24 in a substantially L-shaped media feedpath 21 beneath the carriage 26 and cartridges 28. As the media moves into a printing zone, the media moves in a first, Y-direction as depicted and the carriage 26 and the cartridges 28 move in a second, X-direction which is transverse to the movement of the media M.

Referring again to FIG. 1, the scanner portion 12 generally includes an automatic document feed (ADF) scanner 13, a scanner bed 17 and a lid 14 which is hingedly connected to the scanner bed 17. Beneath the lid 14 and within the scanner bed 17 may be a transparent platen for placement and support of target or original documents for manually scanning. Along a front edge of the lid 14 is a handle 15 for opening the lid 14 and placement of the target document on the transparent platen (not shown). Adjacent the lid 14 is an exemplary duplexing ADF scanner 13 which automatically feeds and scans stacks of documents which are normally sized, e.g., letter, legal, or A4, and suited for automatic feeding. Above the lid 14 and adjacent an opening in the ADF scanner 13 is an ADF input tray 18 which supports a stack of target media or documents for feeding through the auto-document feeder 13. Beneath the input tray 18, the upper surface of the lid 14 also functions as an output tray 19 for receiving documents fed through the ADF scanner 13.

Figure 3:
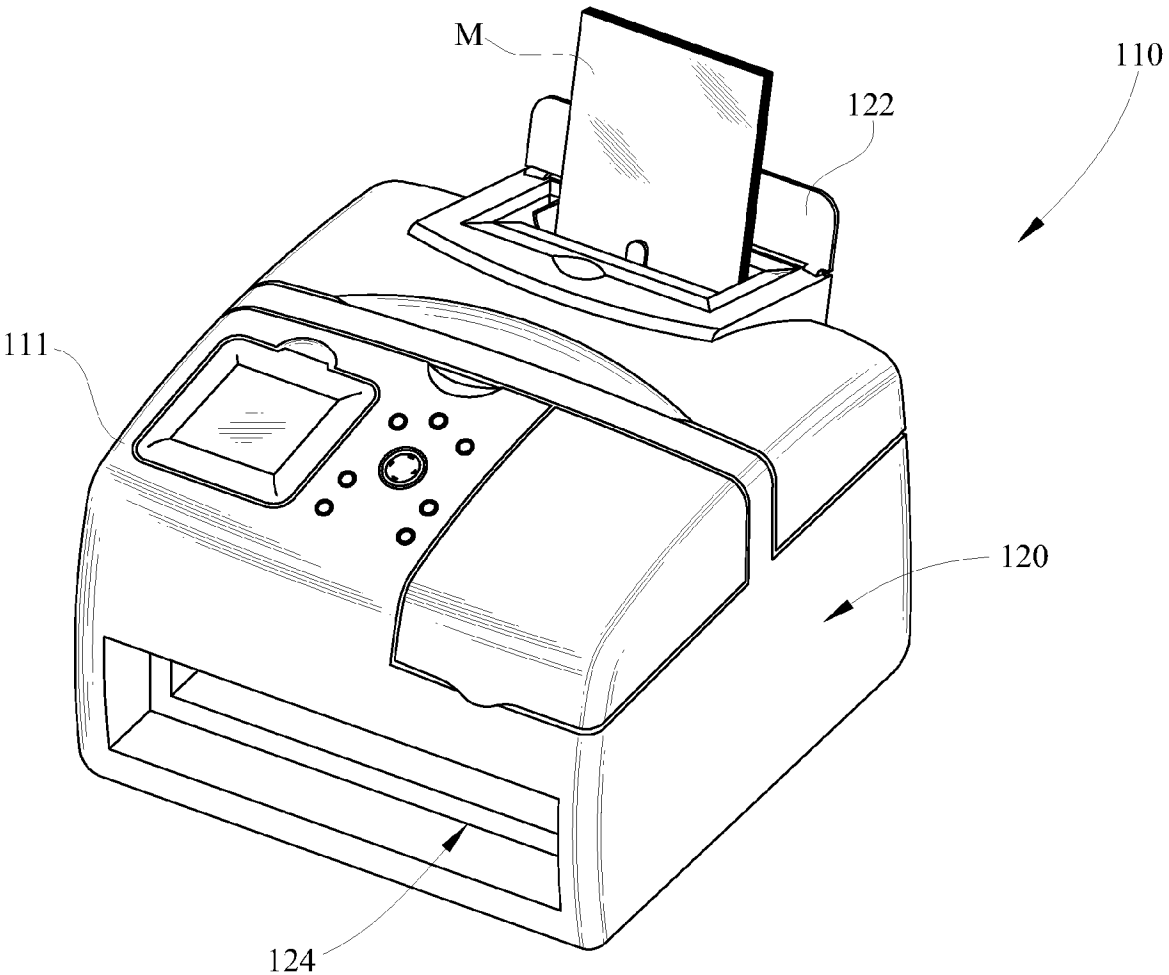
FIG. 3 is a perspective view of an alternative photo printer which performs edge-to-edge printing.

Referring now to FIG. 3, an alternative photo printer 110 is depicted which may also utilize the trough support ribs of the present invention. The photo printer 110 comprises a printer portion or component, depicted generally as 120. The upper front surface of the photo printer 110 may utilize a control panel 111 having a plurality of control buttons as well as an LCD screen for displaying photos to be printed. The control buttons may also be utilized to format the photos within the LCD display prior to printing. The photo printer 110 comprises an input tray 122 near the rear surface of the printer 110. The input tray 122 is substantially vertical and receives a plurality of media M therein. The output area 124 is substantially horizontal so that a media feedpath (not shown) extending through the printer 110 is substantially L-shaped. It should be noted however, that in either of the embodiments of FIGS. 1-3, alternative media feedpath shapes may be utilized, such as, for example, a C-shaped path.

Figure 4:
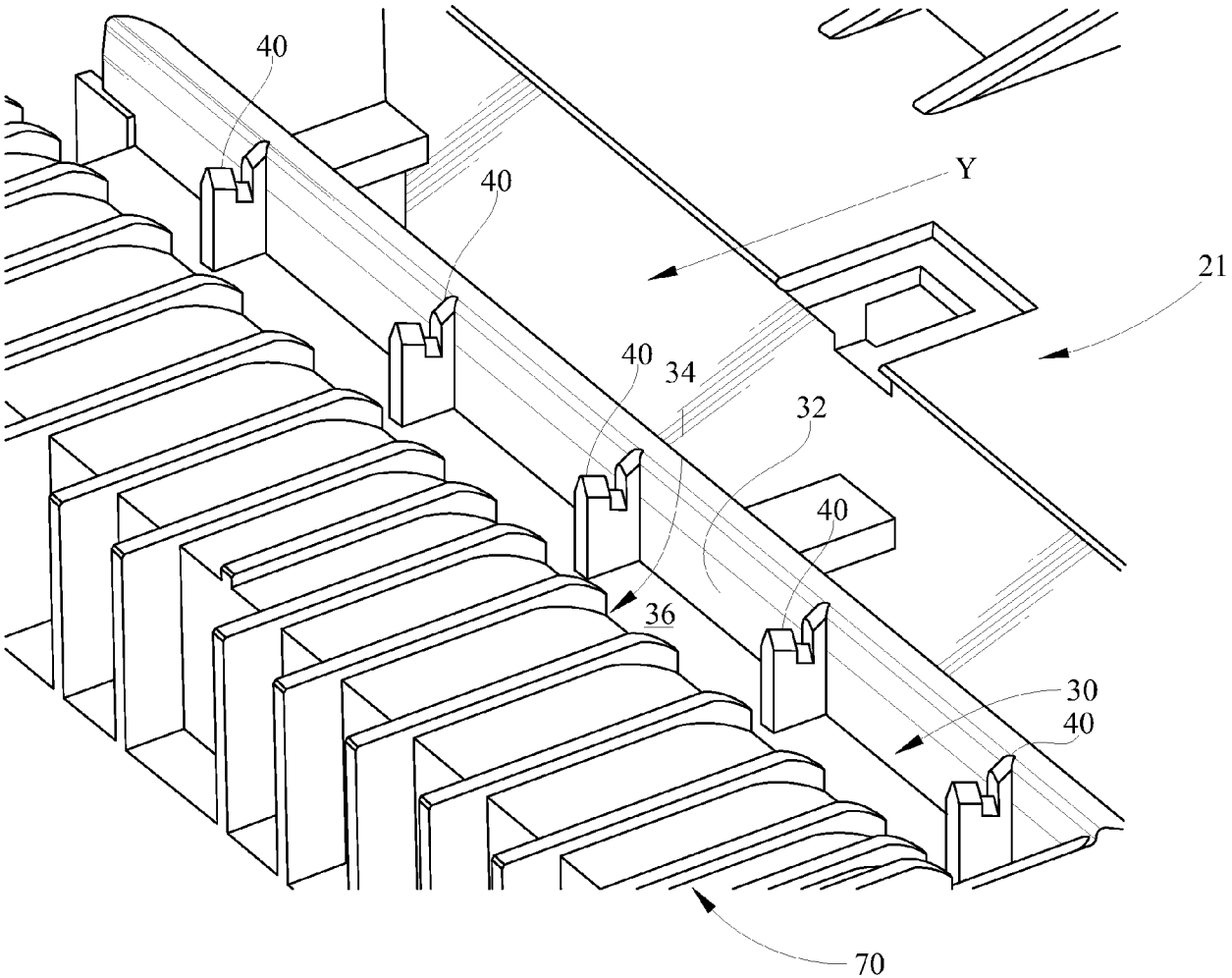
FIG. 4 is a perspective view of a first embodiment of an ink trough including support ribs of the present invention.

Referring now to FIG. 4, a perspective view of a media feedpath 21 is depicted near a print zone along the interior of the printing component 20. It should be noted that the printing component 20 and media path 21 of the all-in-one device is discussed herein but such printing device could alternatively be a photo printer or any other inkjet printer which performs edge-to-edge printing and therefore is not limited to the all-in-one device depicted in FIGS. 1 and 2. The media path 21 is depicted as having a media feed direction Y which corresponds to the media feed direction Y in FIG. 2. Disposed along the media feedpath 21, is an ink trough 30. The ink trough 30 is substantially rectangular in shape having a longer dimension in the X-direction (FIG. 2) and a shorter dimension in the Y-direction. The X-dimension is at least the length of the scanning distance of carriage 26 to catch ink over-spray. The Y-dimension is at least substantially equal to at least the length of a printhead of the cartridge 28. The ink trough 30 comprises an upstream wall 32 which extends in a substantially vertical direction. Opposite the upstream wall 32 is a downstream wall 34 which also extends substantially vertically to partially define the ink trough 30. The terms upstream and downstream are directional descriptors with respect to the Y-direction. Extending between the upstream wall 32 and downstream wall 34 is a floor 36. The floor 36 is substantially horizontal and extends between the lower edges of the upstream and downstream walls 32, 34 to define a volume which forms the ink trough 30. Downstream from the ink trough 30 are a plurality of parallel exit ribs 70. The exit ribs extend at various lengths in the Y-direction. The exit ribs 70 function to support the media which has passed through the print zone and nears the exit rollers of the print device.

Within the ink trough 30 are a plurality of ribs 40. Each of the ribs 40 extend from the upstream wall 32 downstream in the Y-direction into the ink trough 30. The ribs 40 are connected along a lower surface to the floor 36 of the ink trough 30. The ribs 40 are therefore aligned in the X-direction and support the media M as the leading edge and trailing edge pass over the ink trough 30 which is generally disposed beneath the print zone.

Figure 5:
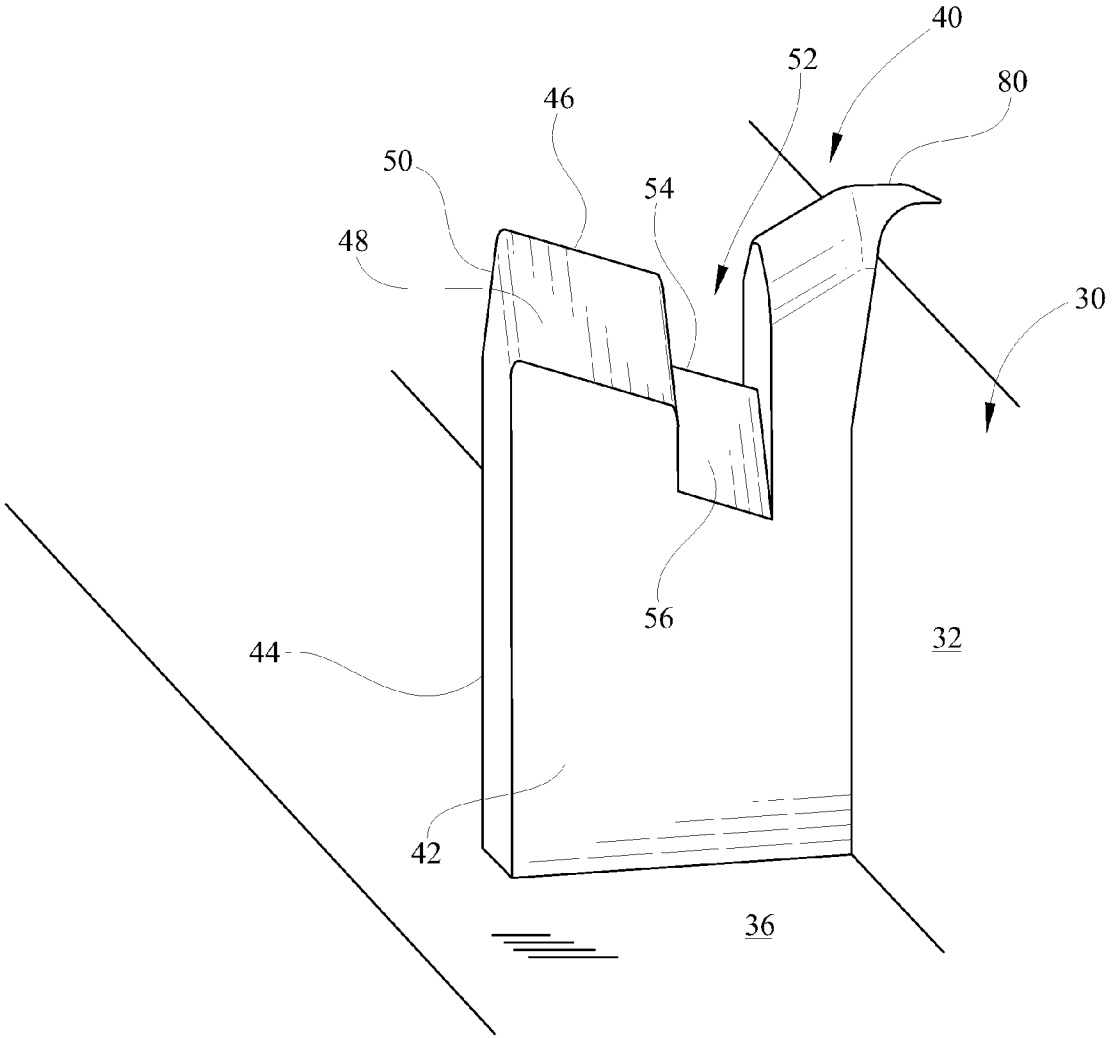
FIG. 5 is a perspective view of one the support ribs of FIG. 4.

Referring now to FIG. 5, a perspective view of one rib 40 is depicted in the ink trough 30. The rib 40 extends from the upstream wall 32 and into the trough 30 along the floor 36. The rib 40 has a first wall 42 and a second opposed wall 44. The walls 42, 44 extend upwardly from the floor 36 and along the upstream wall 32. The first and second walls 42, 44 are generally substantially U-shaped with the upstream sides having a height which is slightly greater than the downstream sides. The downstream side of the rib 40 comprises an upper tapered edge 46. The upper tapered edge 46 is defined by a first tapered surface 48 and a second tapered surface 50. The upper tapered edge 46 provides less exposed surface area than a flat surface along the upper portion of the rib 40 thereby decreasing the transfer of overspray ink from the rib 40 to medium M passing above the rib 40. Since the edge 46 also has a taper, the uppermost downstream side of the rib 40 acts as a contact point rather than a larger contact surface area and further minimizes the transfer of ink overspray from the rib 40 to the media M passing above.

The upper tapered edge 46 is higher at a downstream position than an upstream position which minimizes a contact with the media as the media passes above the rib 40. The upstream side of the rib 40 is connected to a primary support rib 80. The media M stays in contact with the primary support rib. More specifically, the taper of the edge 46 enhances movement of the ink overspray downward along the tapered edge 46 and into the trough 30. Further, the overspray ink also moves down the first and second tapered surfaces 48, 50. Thus, ink movement is directed away from the upper tapered edge 46 which decreases the possibility of ink smear affecting a medium M passing above the rib 40.

Figure 7:
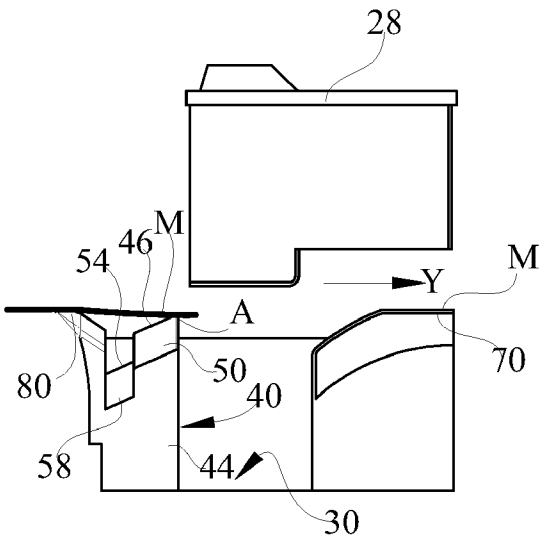
FIG. 7 is a first sequence side view of the embodiment of FIG. 4.

Moving downward form the uppermost position of the tapered edge 46, the rib 40 steps down defining a notch 52. The notch 52 comprises a lower tapered edge 54. The lower tapered edge 54 is parallel to the upper tapered edge 46 and extends in the Y direction or the media feed direction. Like the upper tapered edge 46, the lower tapered edge 54 is also higher at a downstream end than an upstream end. The edge 54 is defined by a first lower tapered surface 56 and a second lower tapered surface 58 (FIG. 7). The edge 54 provides less surface area for overspray ink to engage. The notch 52 may receive overspray of ejected ink directly or may receive ink which runs from the first and second tapered surfaces 48, 50 or from the upper tapered edge 46. The lower tapered surfaces 56, 58 direct movement of the ink from the rib 40 down the walls 42, 44 and into the ink trough 30 and therefore also inhibit ink smear.

Figure 6:
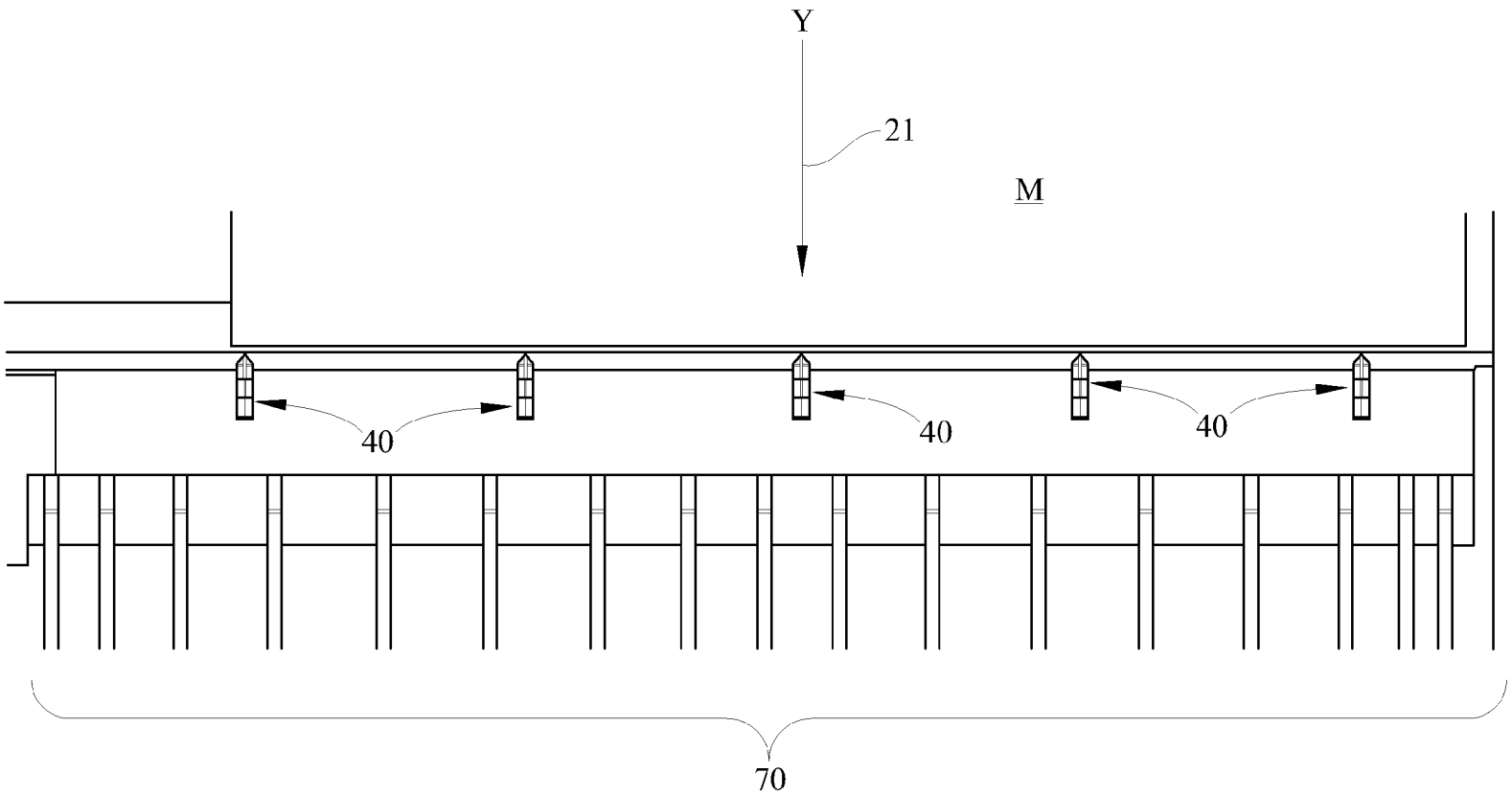
FIG. 6 is a top view of the first embodiment of the support ribs of FIG. 4.

Referring now to FIG. 6, a top view of the ink trough 30 is depicted within the media feedpath 21. Within the ink trough 30 are the plurality of support ribs 40. Downstream of the plurality of ribs 40, in the media feed direction Y, are a plurality of exit ribs 70. The top view clearly depicts that the ribs 40 are each offset from the exit ribs 70 in the X-direction. Thus, the ribs 40 are not aligned with the exit ribs 70 in the Y-direction. This offset design inhibits transmission of any ink which contaminates the support ribs 40 from being transferred to the exit ribs 70. Specifically, if ink contaminates the support ribs 40 and is transferred to a subsequent sheet of media M, the media will pass over the exit ribs 70. However, because of the offset any ink transferred from a rib 40 to the media will not contaminate the exit rib 70.

Figure 9:
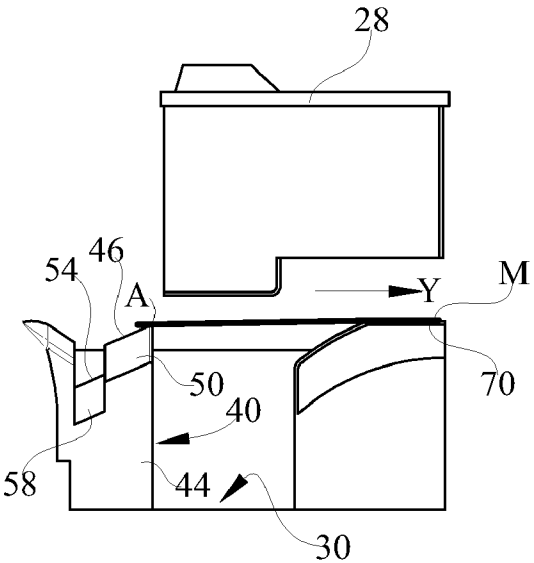
FIG. 9 is a third sequence side view of FIG. 7.
Figure 8:
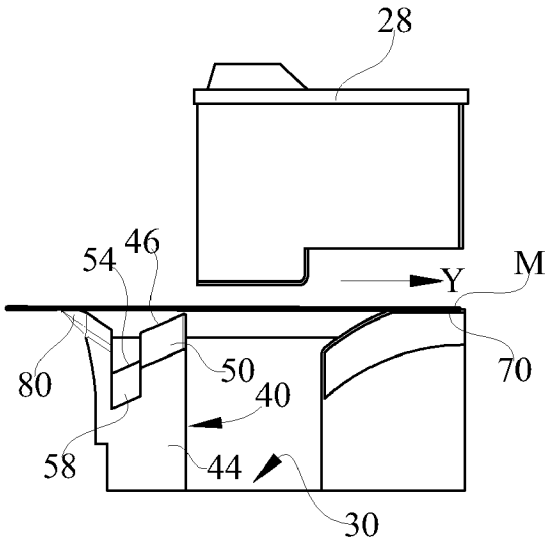
FIG. 8 is a second sequence side view of FIG. 7.

Referring now to FIGS. 7-9, a sequence of side views depicts a leading edge of the media M traveling in the media feed direction Y through the print zone and over the ink trough 30 and depict the ink trough 30 and trough support rib 40 from the opposite side depicted in FIG. 5. FIGS. 7-9 also show the ink trough 30 adjacent the print cartridge 28. The media M is moving in the Y direction along the media feed path 21. At point A, the leading edge of the media M is engaging the trough support ribs 40 as the media M enters the print zone.

FIG. 8 depicts the media M continuing to move in the feedpath 21, along the feeding direction Y. The trailing portion of the media M is supported by the primary media support rib 80. The leading edge of the media M is supported by the exit ribs 70. The media M is spanning the ink trough 30 from the exit ribs 70 to the primary support ribs 80. The media M is not contacting the support rib 40 since the upper edge 46 of rib 40 does not extend to the height of primary support rib 80 ad exit rib 70. As shown in FIG. 8, the media M is supported near the trailing edge and leading edge and maintains a substantially constant distance from the print cartridge 28.

Referring now to FIG. 9, the media M is advanced further along the feed direction Y so that at point A the trough support rib 40 is supporting the media M closer to the trailing edge as the media is directed through the print zone beneath the print cartridge 28. The media forward of the trailing edge is supported at the exit ribs 70 since the trailing edge is supported by the support rib 40, the distance between the print cartridge 28 and the media M changes only slightly. Since the trailing edge is supported, the media M does not drop into the ink trough 30 or away from the print cartridge 28 any distance which will adversely affect print quality. The design allows for maintaining high print quality near the edge of the media M.

Figure 10:
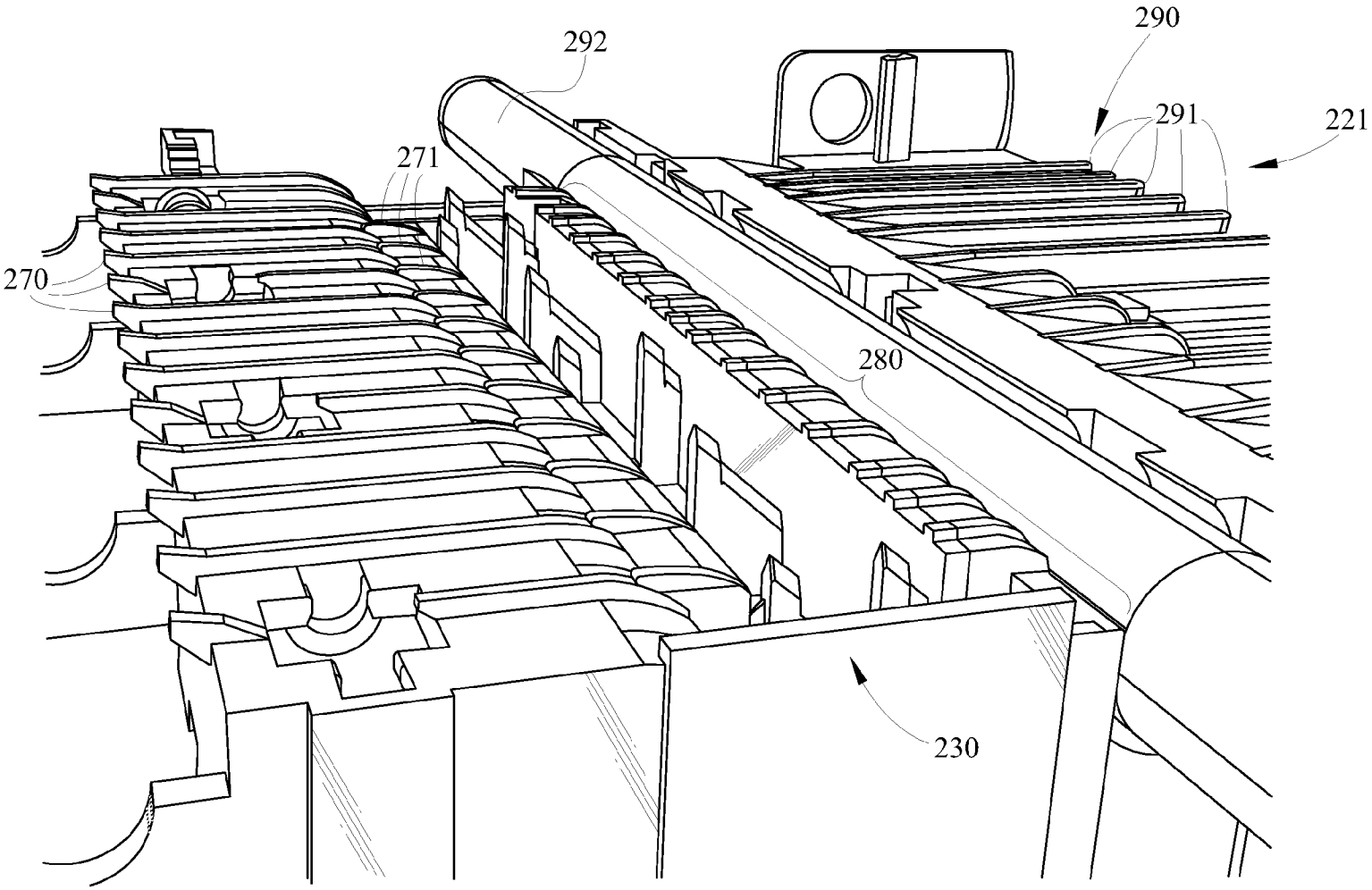
FIG. 10 is a perspective view of a second embodiment of the present invention located in the media feedpath.

Referring now to FIG. 10, a second embodiment of the trough support ribs are depicted. A mid-frame 290 is shown in perspective view comprising a plurality of components including an ink trough 230. A media feedpath 221 is depicted as extending in a direction parallel to the upper surface of the mid-frame 290. Adjacent to upstream ribs 291 is a feed roller 292 which is driven by a transmission (not shown) and a driving source (not shown) such as a motor. The feed roller 292 in combination with an opposing roller not shown forms a nip through which media is directed into the print zone immediately downstream of the feed roller 292 along the media feedpath 221 and above the ink trough 230. Immediately upstream of the ink trough 230 are a plurality of primary media support ribs or cockle ribs 280. The ribs 280 extend along the mid-frame 290 adjacent the feed roller 292 in the direction of the media feedpath 221 up to and including an upper edge portion of the ink trough 230. Downstream of the ink trough 230 are a plurality of transition ribs 271. The transition ribs 271 raise the edge of the media up to a height of the plurality of exit ribs 270 downstream of the transition ribs 271. The transition ribs 271 include an upper curved surface which is lower at an upstream end and raises toward a downstream end adjacent the upstream ends of the exit ribs 270. The transition ribs 271 aid in inhibiting media jams which would may occur if the leading edge of the media passes through the media feedpath 221 and engages the exit ribs 270 without being elevated. However, one skilled in the art should recognize that the transition ribs 271 may or may not be necessary depending on the height of the ink trough 230 and primary media support ribs 280 in relation to the height of the exit ribs 270.

Figure 11:
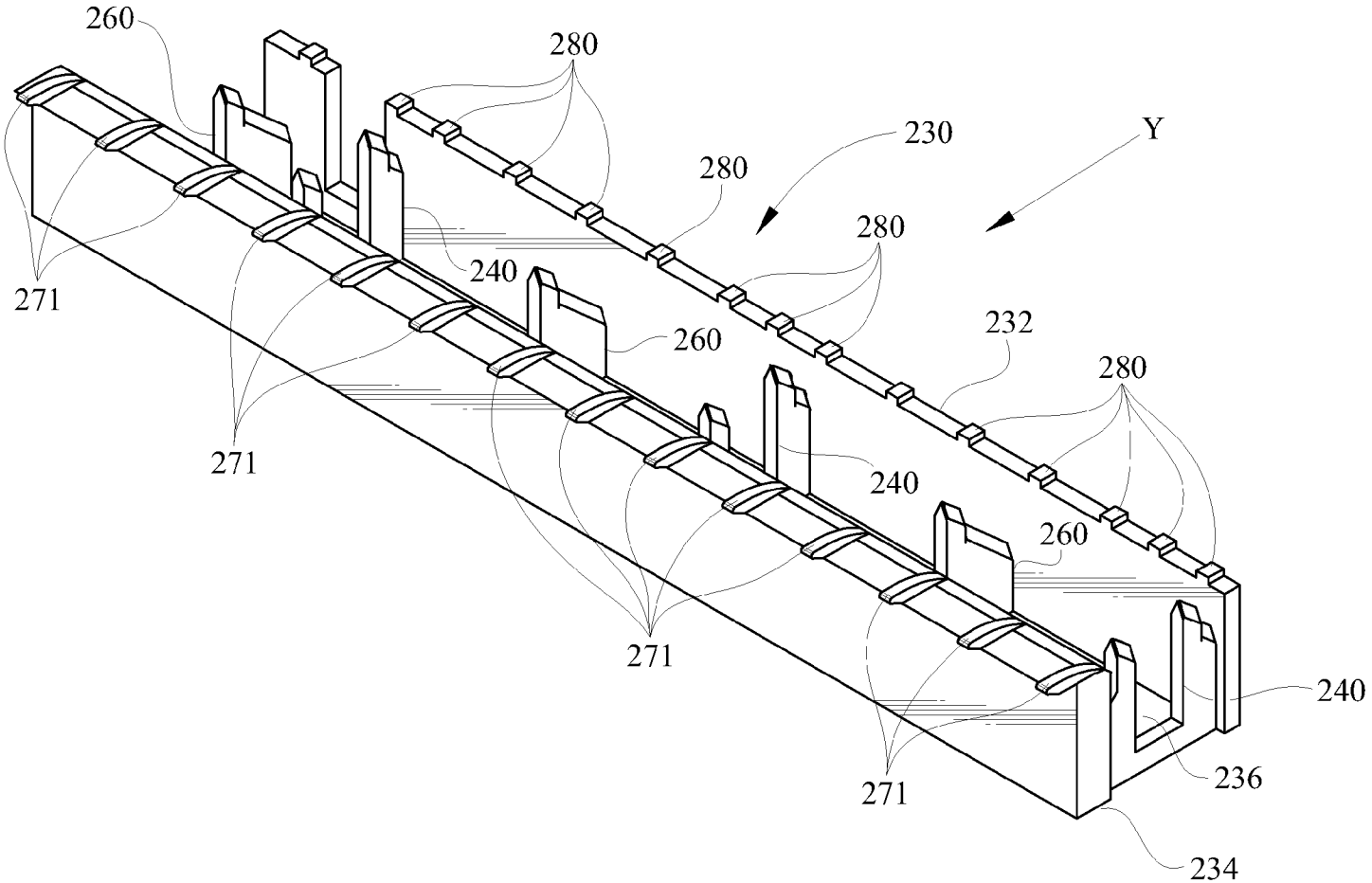
FIG. 11 is a perspective view of the second embodiment removed from the media feedpath.

Referring now to FIG. 11, a perspective view of the ink trough 230 is depicted removed from the surrounding mid-frame 290 (FIG. 10). At an upstream end of the ink trough 230 is an upstream wall 232. Along an upper edge of the upstream wall 232 are a plurality of primary media support ribs 280. The primary media support ribs 280 are an extension of the ribs along the mid-frame 290 (FIG. 10). Opposite the upstream wall 232 is a downstream wall 234. Extending between the upstream and downstream walls 232, 234 is a floor 236 which, in part, generally form a volume defining the ink trough 230. Extending along the upper surface of the downstream wall 234 of the ink trough 230 are a plurality of exit transition ribs 271. The exit transition ribs 271 have a curved upper surface which raises the leading edge of the media to a height necessary to inhibit media jams as a media leading edge engages the exit ribs 270 (FIG. 10). Extending from the floor 236 of the ink trough 230 are a plurality of first ribs 240 and second ribs 260.

Figure 12:
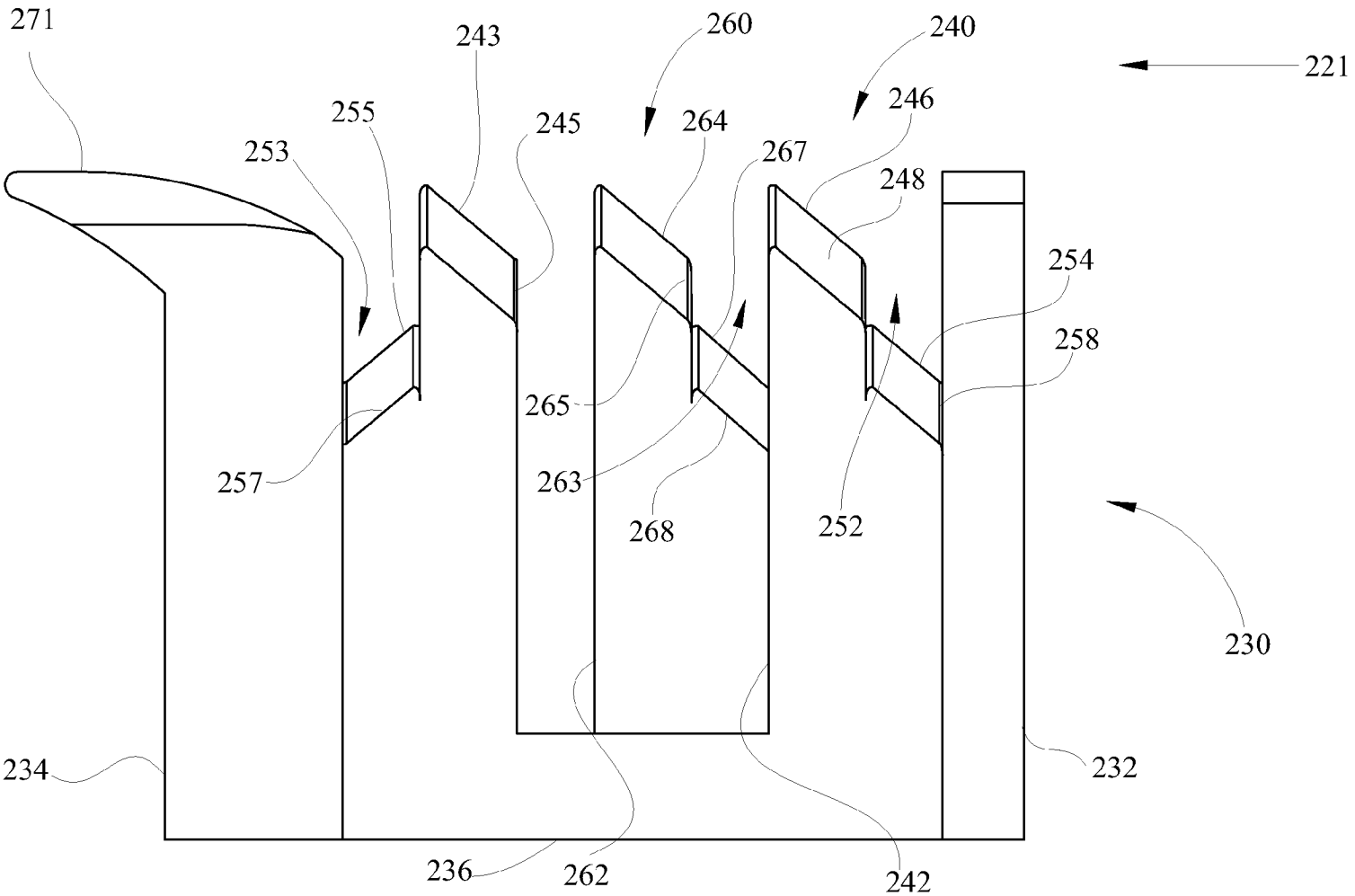
FIG. 12 is a side view of the second embodiment of the present invention from the opposite side of FIG. 11.
Figure 13:
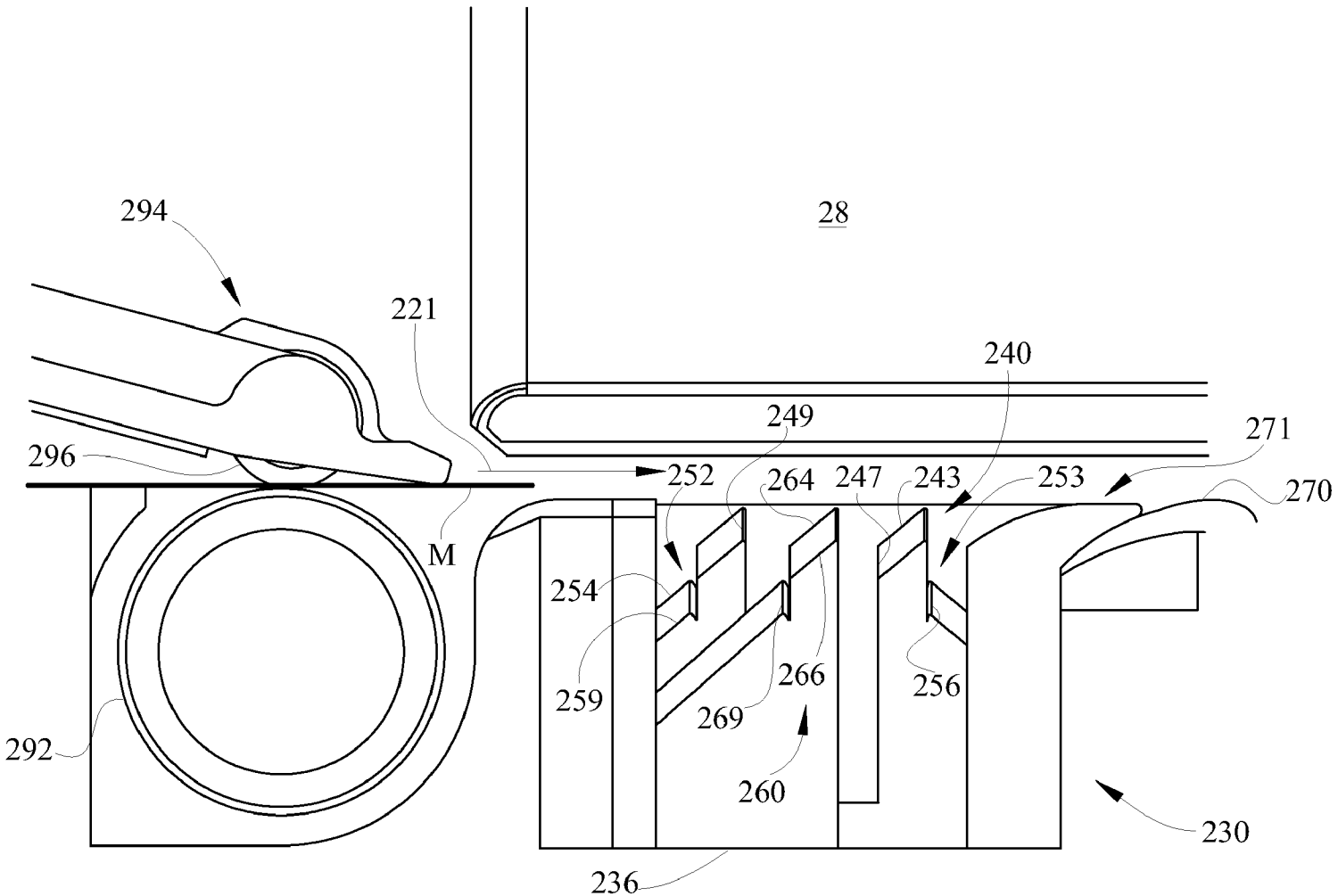
FIG. 13 is a side view of the second embodiment of the present invention.

Referring not to FIG. 12, a side view of the ink trough 230 is shown which depicts the shapes of the ribs 240, 260. The first rib 240 comprises a substantially U-shaped body 242. For rib 240, on the upstream side and downstream side of the feedpath 221 are angled upper edges 246 and 243, respectively, which are angled from a lower upstream end to an upper downstream end and thereby form a point at the downstream end of each edge 246, 243. The upstream angled upper edge 246 is defined by an upper tapered surface 248 and opposed surface 249 (FIG. 13). The downstream angled upper edge 243 is defined by upper tapered surface 245 and opposite surface 247 (FIG. 13). At the upper downstream end of the downstream angled upper edge 243 is a notch 253 comprising an angled lower edge 255 defined by a lower tapered surface 257 and opposite lower tapered surface 256. On the opposite (upstream) side of the U-shaped body 242 a notch 252, is defined between the angled upper edge 246 and the upstream wall 232 of the ink trough 230. The notch 252 comprises an angled lower edge 254 which is angled from a lower upstream end to an upper downstream end. The lower edge 254 is defined by a lower tapered surface 258 and opposite surface 259 (FIG. 13). The U-shaped body 242 extends from the upstream wall 232 to the downstream wall 234 and along the floor 236 of ink trough 230. The plurality of first ribs 240 are spaced along the length of the ink trough 230.

FIG. 12 also depicts the second rib 260. The second rib 260 is defined by a body 262 extending from the upstream wall 232 of the ink trough 230 and is disposed between each of the first ribs 240 within the ink trough 230. The body 262 extends from the upstream wall 232 and upwardly from the floor 236. The second rib 260 comprises an angled upper edge 264 which is angled from a lower upstream end to an upper downstream end of the edge. The uppermost end of the upper edge 264 has a height which is substantially equal to the highest points of the angled upper edges 243, 246 of the first rib 240. The angled upper edge 264 is defined by an upper tapered surface 265 and opposed tapered surface 266 (FIG. 13). Upstream of the angled upper edge 264 is a notch 263 extending from the upstream wall 232. The angled lower edge 267 is defined by a lower tapered surface 268 and opposite tapered surface 269 (FIG. 13). The angled lower edge 267 is longer than the angled upper edge 264 and extends to the upstream wall 232. Each of the tapered surfaces of the first and second ribs 240, 260 aid in moving oversprayed ink away from the upper edges and lower edges of the ribs 240, 260. This inhibits ink from transferring to the rear surface of the media. The height of the uppermost points of the upper edges of ribs 240, 260 are less than the primary media support ribs 290 and exit transition ribs 271. Thus, the media M moving across feedpath 221 will only engage the first and second ribs 240, 260 as the leading edge and trailing edge of the media M extends over the ink trough 230.

The upper edge 246 and lower edge 254 of the first rib 240 are aligned in the media feed direction and substantially parallel to one another. The upper edge 243 and lower edge 255 are aligned but not parallel. As a result the first ribs 240 are somewhat symmetrical about a vertical axis. Likewise, the upper and lower edges 264, 267, respectively, of the second ribs 260 are aligned and substantially parallel to one another.

Referring now to FIG. 13, the ink trough 230 is depicted from the opposite side as is shown in FIG. 12. Also depicted is the print cartridge disposed above the ink trough 230 and the media M being directed along the feedpath 221 by a feed roll 292 and a pinch roller assembly 294 having a pinch roller therein 296. Downstream of the ink trough 230, the exit transition ribs 271 are depicted adjacent the exit rib 270.

Figure 14:
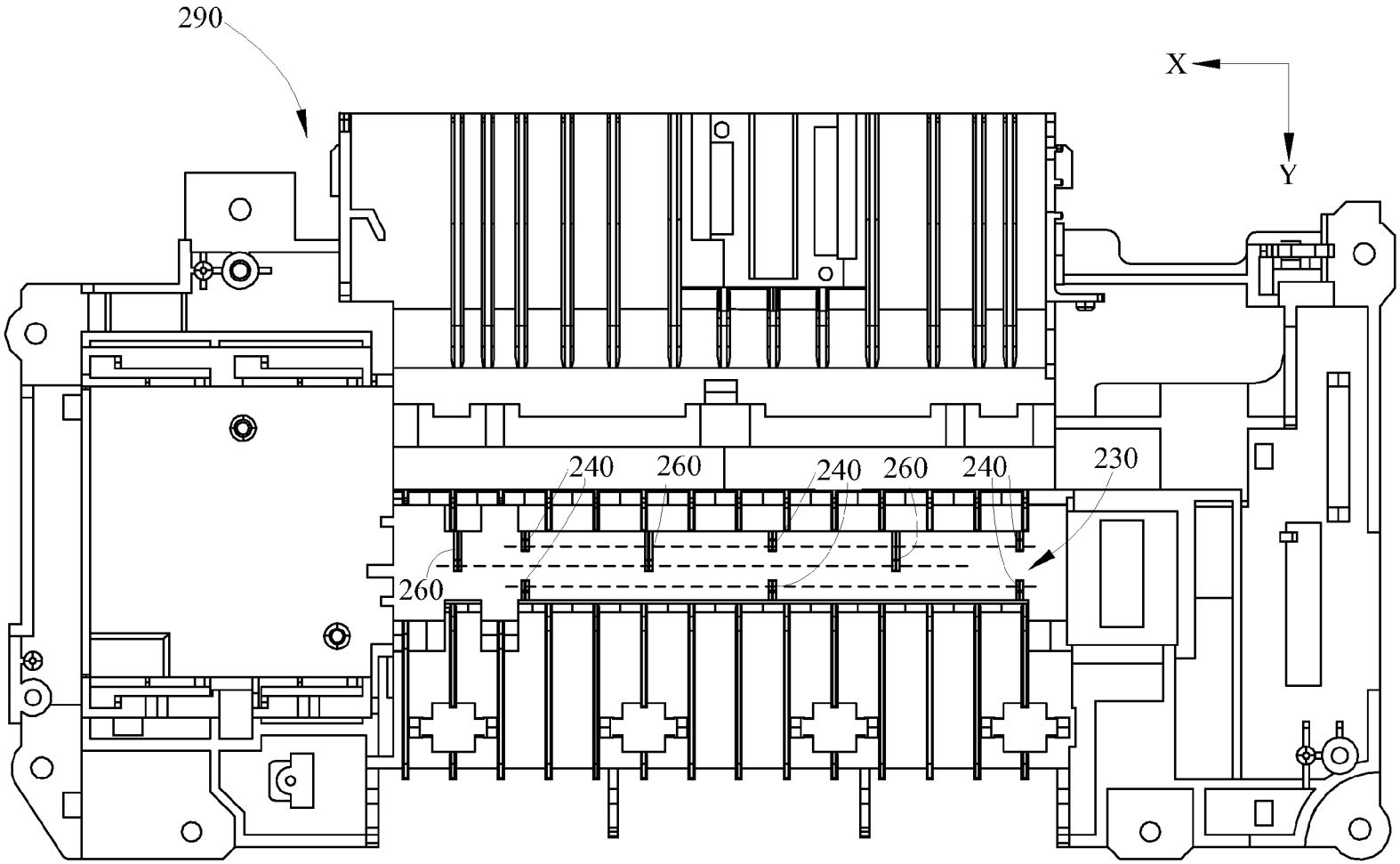
FIG. 14 is a top view of the second embodiment of FIG. 11.

Referring now to FIG. 14, a top view of the mid-frame 290 is depicted. As shown, the ink trough 230 comprises the plurality of ribs 240, 260 alternately disposed therein in the X-direction or carriage scan direction. The ribs 240, 260 are equidistantly spaced across the trough 230. However, one or more ribs 240, 260 may not be spaced apart equally due to limitations of feedpath width and necessary spacing dimensions not being equally divisible. Such spacing supports the leading edge and trailing edge of the media substantially equally across the print zone and the ink trough 230 below. As shown in FIGS. 12 and 14, the second ribs 260 are offset in the media feed direction or y-direction with respect to ribs 240. Due to such offset, the upper edge 264 of second rib 260 is disposed between the upper edges 243, 246 or first rib 240.

As previously indicated, the leading and trailing edges of the media need support as they move across the ink trough 230. The spacing of the ribs 240, 260 in the X-direction and offset in the Y-direction provides improved support across the ink trough 230. The contact point of the upper edge 264 is positioned between the contact points of the upper edges 243, 246. As shown by the three dashed lines, three lines of point support are provided to the leading and trailing edges of the media as they traverse the trough 230. Such design improves support of the leading and trailing edges of the media for improved edge to edge printing.

Figure 15:
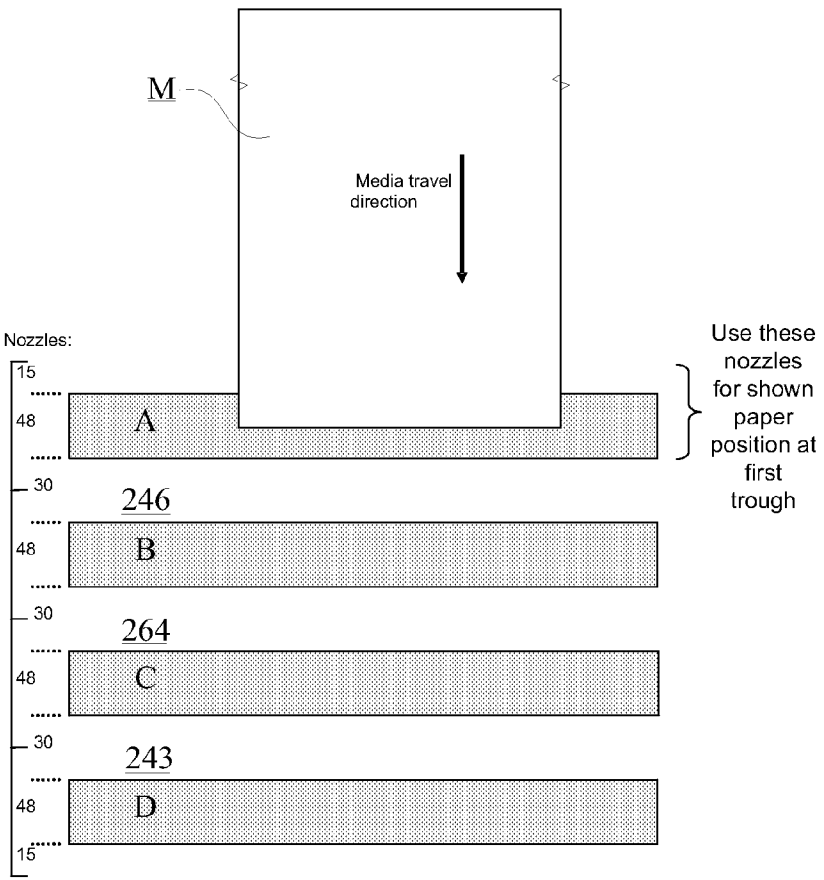
FIG. 15 is a top schematic view of media having a leading edge disposed above a first subtrough section.

FIGS. 15-22 depict various processes of moving media over a trough 230 (FIG. 12) having multiple trough sections or subtroughs A-D therein such that the printhead 28 (FIG. 13) only ejects ink from areas where the media is covering one or more subtrough portions A-D or a support structure. Referring first to FIGS. 15-18, schematic top views of a media feedpath trough 230 (FIG. 10) are depicted with the media M passing over the subtroughs in various positions of media feed. The media M is not shown to scale relative to trough 230. Along the left hand side adjacent the subtroughs A, B, C, D are numbers corresponding to the printhead nozzle rows. The numbers represent nozzle rows of the printhead 28 so as to relate the printhead nozzles to the trough 230 and the subtroughs A, B, C, D therein. Referring to FIGS. 12 and 15, the first trough section or subtrough A is generally disposed above edge 254 adjacent notch 252. Subtrough B is generally located above edge 267 adjacent notch 263. Subtrough C is generally disposed between ribs 260 and the downstream portion of rib 240. Finally, subtrough D is disposed above edge 255 adjacent notch 253. In the exemplary embodiment, there are 312 printhead nozzle rows extending from upstream of the subtrough A to downstream of the subtrough D in the media feed direction. The printhead 28 includes 15 nozzle rows upstream of the subtrough A and 48 nozzle rows extending over the subtrough A. The printhead 28 further comprises 30 printhead nozzle rows between the subtrough A and subtrough B and again comprises 48 nozzle rows above the subtrough B. Between the subtrough B and subtrough C are 30 printhead nozzle rows and 48 printhead nozzle rows extend above the subtrough C. Likewise, between the subtroughs C and D are 30 printhead nozzle rows and 48 printhead nozzle rows over the subtrough D. The printhead 28 finally comprises 15 printhead nozzle rows extending beyond the subtrough D. In total, the exemplary embodiment includes 312 printhead nozzle rows however, various printhead sizes may be utilized which comprise more or less printhead nozzle rows which would therefore change the spacing of rows between and above the subtroughs A through D. The nozzle rows may be selectively operated according to the location of media relative to the subtroughs A-D and the printhead 28. Additionally, fewer or greater subtroughs may be utilized with varying size and such design is considered to be within the scope of the present invention.

FIG. 15 depicts the media M indexed to a position over the first subtrough A, specifically, the leading edge of the media M at about the midway point of the subtrough A. Further, the leading edge of the media M is generally positioned over the middle of subtrough A so that the nozzles disposed about the subtrough A may be utilized to overspray in the area of the media leading edge, and trailing edge as described further herein, which inhibits print defects associated with edge to edge printing. The media leading edge, and trailing edge described later, are positioned over the subtroughs A-D in nominally aligned positions which are approximately known by the print controller and accurate to within a known tolerance. The print structure and method further inhibit ink spray from accumulating on the media supports within the trough region 230 that define the four subtroughs A through D. With the leading edge of media M disposed over the subtrough A, the media is nominally aligned with a pre-selected nozzle row. The pre-selected nozzle row will be different for different printing modes. Three printing modes will be described hereinafter which include a four pass print mode wherein the printhead 28 makes a single pass over each subtrough A-D for each of the media leading edge and trailing edge. Alternatively, an with pass print mode may be utilized wherein two printhead passes are made over the leading edge and trailing edge positioned in two locations within each subtrough A through D. In a further alternative, a 16 pass print mode may be utilized wherein four printhead passes are made with the leading edge and trailing edge disposed in four positions within each of subtrough A through D. One skilled in the art will realize that additional passes improve print quality.

Referring again to the four pass print mode depicted in FIG. 15, the media M leading edge disposed in a pre-selected position of the first subtrough A, the print controller may selectively eject ink through nozzle rows 1-63 in order to partially form an image on the leading edge of the media M and thereby reduce print defects. By repeating this process, as described further herein, an image is fully formed along the leading edge with reduced print defects in comparison to prior art processes. The number 63 is a summation of the first fifteen rows of the printhead 28 which are generally positioned over the ribs 280 of the printer mid-frame 290 (FIG. 10) and the next 48 rows of nozzles which are generally disposed above subtrough A and which total 63. Since the exemplary embodiment is a four pass print mode, the media leading edge does not move from a first to a second position within the subtrough A, but instead is printed upon at a single position above subtrough A. Otherwise stated, the media M does not make any small index moves within the subtrough A, but instead makes a single large move from a leading edge position above subtrough A to a leading edge position above subtrough B. Because the width of the troughs can vary depending on the design of the print portion 20 the moves of the media are described in a relative terms of a "large move" or a "small move." For purpose of this description, the term "large move" describes a move of the media out of a subtrough such as from one subtrough to another subtrough while the term "small move" indicates a move of the media within a subtrough.

Figure 16:
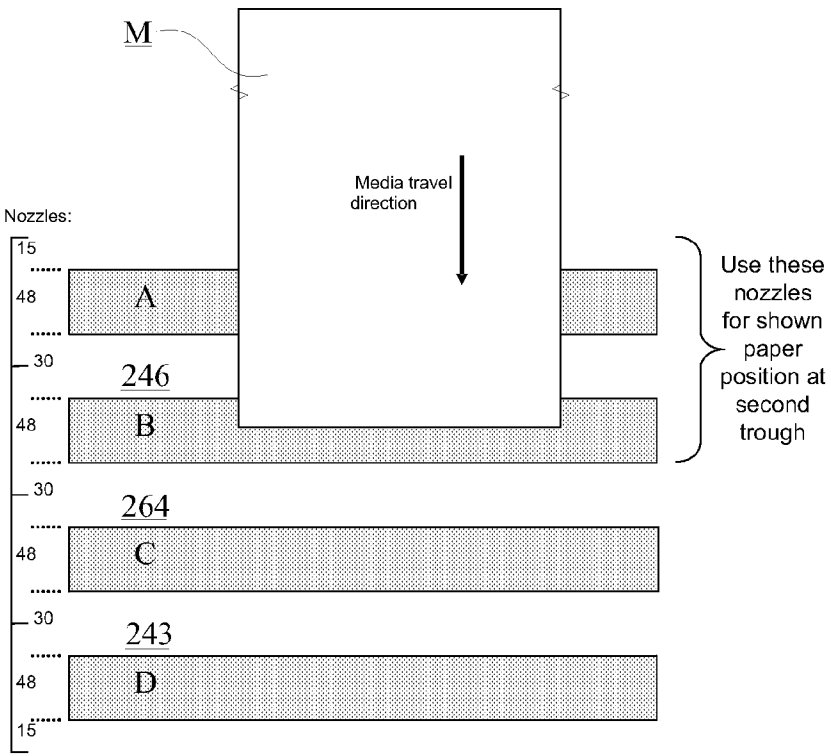
FIG. 16 is a top schematic view of media having a leading edge disposed above a second subtrough and indexed to a position beyond FIG. 15.

As depicted in FIG. 16, the media M is disposed above subtrough B at a pre-selected position generally around the midpoint of the subtrough B in the media feed direction. With the media leading edge disposed above the subtrough B, 141 printhead nozzle rows may be utilized to print without overspraying on the exposed media supports 264, 243 between subtroughs B and C and subtroughs C and D, respectively, as well as the mid-frame area 271 (FIG. 12) downstream of subtrough D. The number 141 is the summation of the 15 printhead nozzle rows above the print mid-frame 290 upstream of subtrough A, the 48 printhead nozzle rows above subtroughs A and B in the 30 printhead nozzle rows between subtroughs A and B. In this position, the leading edge of the media M may again be printed upon by the printhead 28 in the area above the subtrough B so that overspray is captured within the subtrough B and not dispensed upon downstream media support structures 264, 243 or 271.

Figure 17:
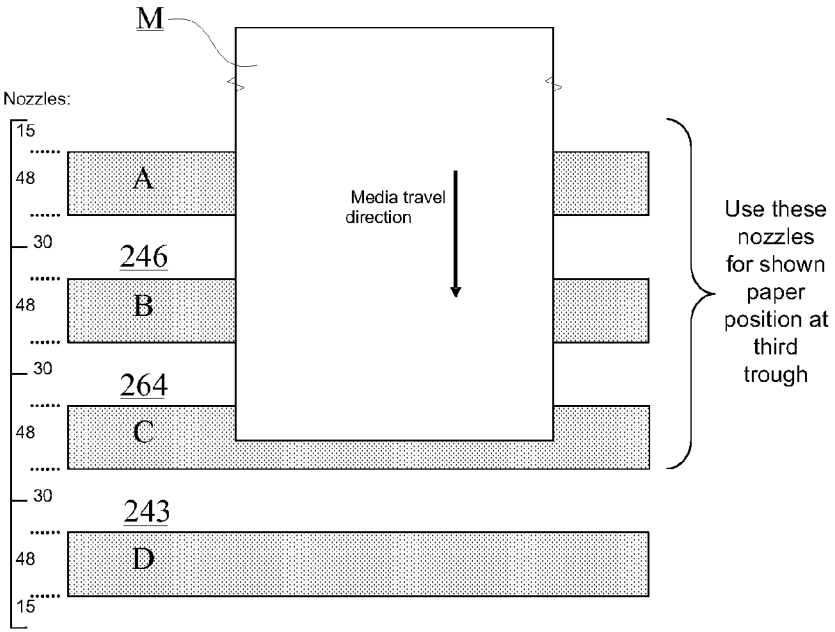
FIG. 17 is a top schematic view of media having a leading edge disposed above a third subtrough and indexed to a position beyond FIG. 16.

Referring now to FIG. 17, the leading edge of media M is advanced from subtrough B to subtrough C such that the media M covers the upstream mid-frame 290, subtrough A, support structure 264 between subtrough A and subtrough B, subtrough B, support structure 264 between subtrough B and subtrough C and portions of subtrough C. Specifically, the media M leading edge is nominally aligned around the central portion of subtrough C at a known position within a tolerance for further printing of the media leading edge to inhibit media M leading edge print defects. In this position, 219 printhead nozzle rows may be utilized to print along the media M and up to the leading edge of the media disposed above subtrough C. The 219 printhead nozzle rows include the 15 nozzle rows above the mid-frame 290 upstream of subtrough A, the 48 nozzle rows above subtrough A and the 48 nozzle rows above subtrough B as well as the 30 nozzle rows between subtroughs A and B and subtroughs B and C, and the 48 nozzle rows above subtrough C. Upon the single pass of the printhead 28 for printing when the media leading edge is located at subtrough C, the media M is indexed in one large move to the subtrough D wherein the process is repeated.

Figure 18:
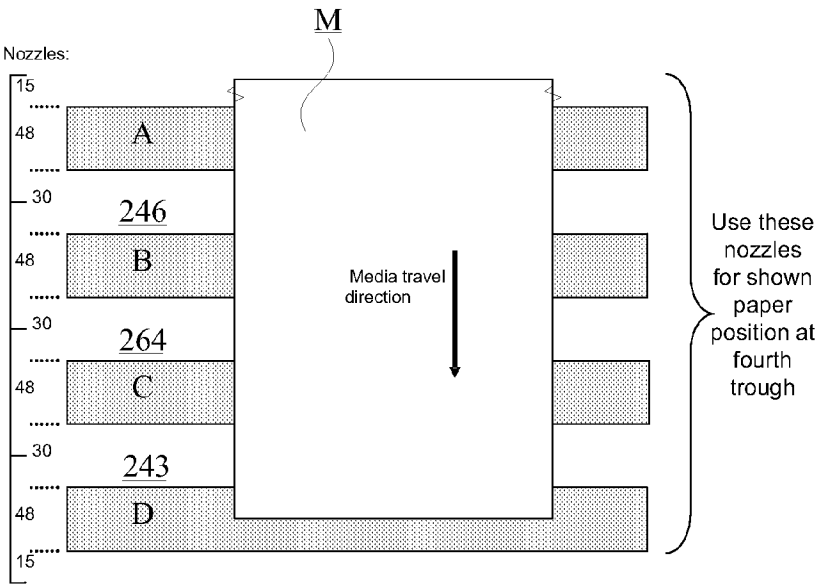
FIG. 18 is a top schematic view of media having a leading edge disposed above a fourth subtrough and indexed to a position beyond FIG. 17.

Referring now to FIG. 18, the media M is indexed to a position above subtrough D. According to the media position depicted, 297 printhead nozzle rows are utilized to form an image from the media leading edge and upstream. Upon further advancing of the media M, all of the nozzles of the printhead 28 may be utilized without contamination of the mid-frame structure 271.

Figure 19:
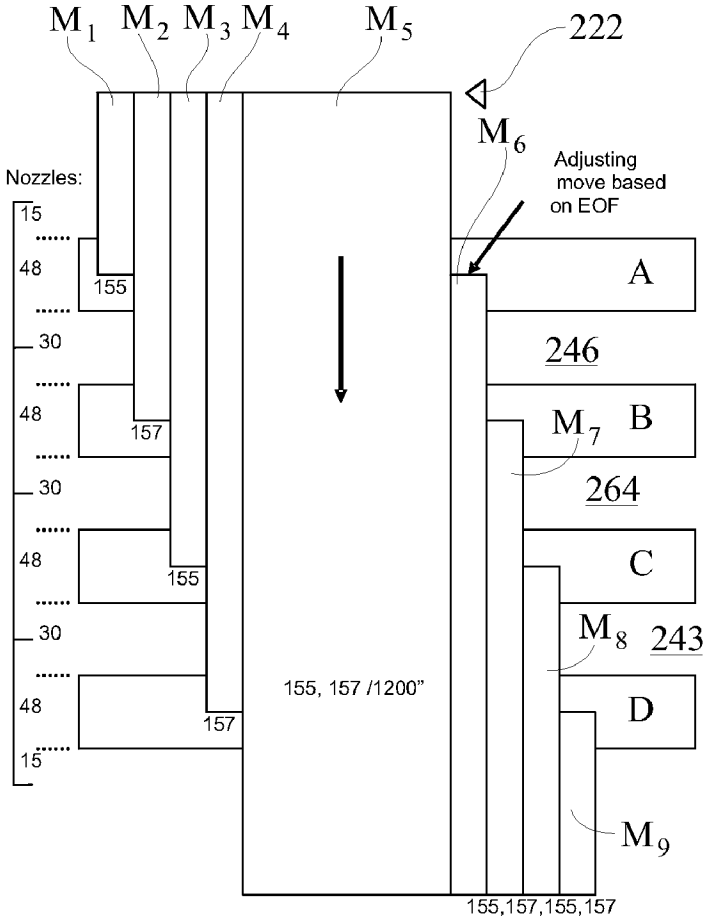
FIG. 19 is a top schematic view depicting a plurality of movements of a media having a leading edge and trailing edge across an ink trough in a four-pass print mode.

Referring not to FIG. 19, a schematic top view is depicted wherein the leading edges and trailing edges of the media M are depicted in multiple positions within a single figure. The embodiment depicted is a four pass print mode. The printhead nozzle rows are again depicted along the left hand side of the subtroughs A through D by number such that the printhead has a total of 312 nozzle rows in the exemplary embodiment. From the left hand side of the drawing, the first media position $M_1$ is depicted above subtrough A as previously described and related to FIG. 15. Following a large move in the depicted four pass print mode, the media M is shown with the leading edge disposed over subtrough B as depicted and previously described in FIG. 16. Following an additional large move, the media M is positioned such that the leading edge disposed over subtrough C in the third position $M_3$. Additionally, following a third large move, the leading edge of the media M is positioned above subtrough D in position $M_4$ such that the printhead rows from subtrough D to the printer mid-frame 290 upstream of said subtrough A may be all utilized. These positions correspond to FIGS. 15-18, respectively. As the media is further indexed into position $M_5$, the media M covers the entire trough 230 such that all of the printhead 28 may be utilized for printing on the media.

Each of the large moves of media M are shown numerically by either the number 155 or 157. These numbers represent $^{155}/_{1200th}$ inch or $^{157}/_{1200th}$ inch. In the exemplary embodiment, the 312 nozzle rows are spaced at $^{1}/_{600th}$ inch row spacing. Further, the exemplary embodiment is printing at 1200 dpi in the media feed direction utilizing the $^{1}/_{600th}$ inch nozzle row spacing. Accordingly, one skilled in the art will recognize that such arrangement requires odd 1200th inch steps in order to properly align the nozzles with all possible drop locations on the media and fully form the image. Further, it is desireable that the numbers be close to equivalent, which minimizes the appearance of print defects. Otherwise stated, larger differential in media steps result in increased visibility of print defects.

Following additional moves, depending on the media length, the media trailing edge passes an end-of-form (EOF) flag 222 which signals the print controller as to the position of the trailing edge of the media M. Accordingly, once the print controller determines the position of the trailing edge of the media M relative to the nominally aligned position over subtrough A, an adjustment move may be made such that the trailing edge is fully positioned over the subtrough A. In the position $M_6$, one skilled in the art should realize that all of the printhead rows may be utilized except for the first fifteen printhead nozzles rows disposed above the mid-frame structure 290 upstream of subtrough A. By eliminating these printhead rows from operation, the mid-frame 290 and ribs 280 thereon are spared from overspray ink which may contaminate a subsequent media sheet passing through the media feed path 21 for example. Next, a large move is made to reposition the media trailing edge above subtrough B wherein the media assumes position $M_7$. In this position, the portions of the printhead upstream of subtrough B including the printhead 28 above the support structure 246 between subtrough A and B, the printhead portion above subtrough A and the printhead portion above the upstream mid-frame are not utilized since the media is not covering those portions which would alternatively overspray the media support structure in adjacent parts. Following the single pass with the media trailing edge above subtrough B, a large move is made to reposition the media trailing edge above subtrough C at media position $M_8$. In this position the printhead nozzle rows disposed above subtrough C, subtrough D and the support structure therebetween as well as the mid-frame thereafter may be selectively operated. Thus, the trailing edge receives a third pass in order to fully form an image along such edge. After another large move, the media M is positioned above subtrough D and media position $M_9$. In this position, the printhead nozzle rows corresponding to subtrough D in the downstream mid-frame are utilized to form an image on the media and overspray the media trailing edge to ensure an image is formed therealong.

Figure 20:
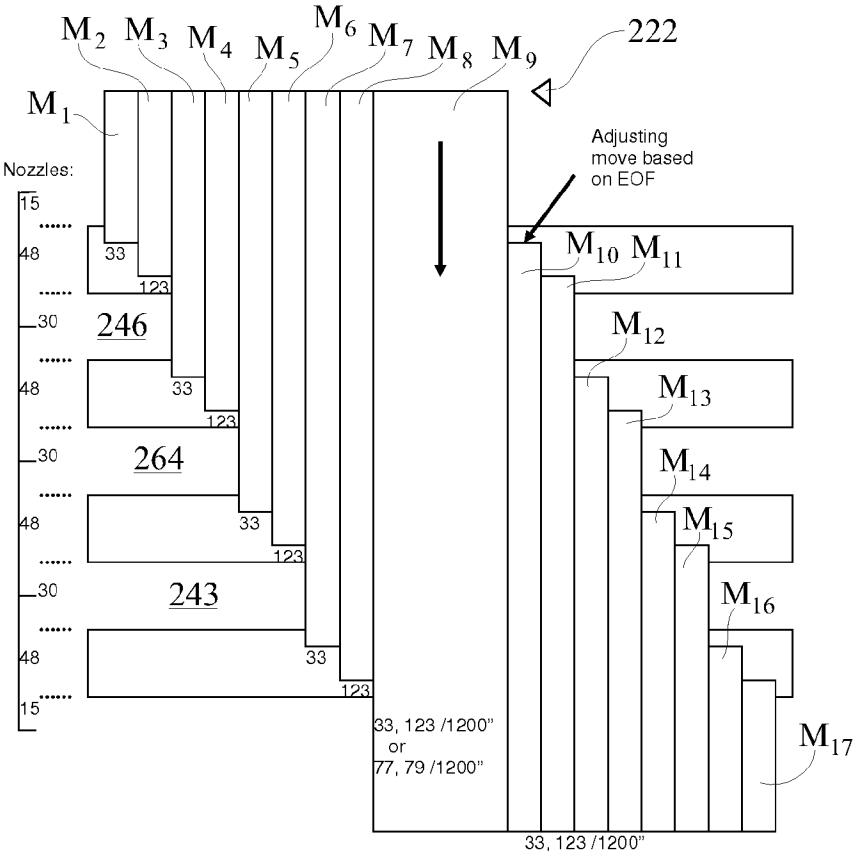
FIG. 20 is a top schematic view depicting a plurality of movements of a media having a leading edge and trailing edge across an ink trough in a eight-pass print mode.

Referring now to FIG. 20, a schematic top view of the media moving across the various subtroughs A-D is depicted. The exemplary embodiment differs from that of FIG. 19 since the depicted movements correspond to an eight pass print mode rather than a four pass print mode. In the depicted eight pass print mode, the media M moves twice within each subtrough A-D. Thus, in total, the printhead 28 makes two printing passes for each of subtroughs A-D. Thus, in total, the printhead 28 makes eight passes to form an image on the media leading edge and eight passes to form an image on the media trailing edge. As depicted in FIG. 20, media M is positioned at a first position $M_1$ with the leading edge disposed in an upstream portion of the subtrough A. In this nominally aligned position, the leading edge is exposed above the subtrough A for forming an image therealong. Accordingly, 48 printhead nozzle rows within subtrough A as well as the 15 printhead nozzle rows upstream of subtrough A may be utilized for printing when the media is in position $M_1$. Subsequently, a small move is made on the order, for example, 33 steps or $^{33}/_{1200}{}^{th}$ inch to position the media leading edge at position $M_2$ which is downstream of position $M_1$, but still within the subtrough A. The printhead 28 then selectively ejects ink from the printhead nozzle rows corresponding to the subtrough A and the upstream mid-frame 290 in order to form an image on media and along the leading edge for further ensuring proper image formation on the leading edge during edge-to-edge printing. Following the second printhead pass with the media leading edge disposed in the subtrough A region, the media is indexed a large move to the upstream side of subtrough B. The large move of the exemplary embodiment is about 123 steps or $^{123}/_{1200}{}^{th}$ inch to align the media leading edge in position $M_3$. In this position the nozzles of the subtroughs B, the region between subtroughs A and B, the subtrough A and upstream mid-frame 290 may be utilized to form an image as well as ensure proper image formation along the leading edge of the media by overspray techniques. After the printhead 28 makes the first pass with the media in the $M_3$ position, the media is indexed a small move, again on the order of 33 steps, to position $M_4$ wherein an image is formed utilizing the printhead nozzle rows corresponding to subtrough B, subtrough A, the area between subtroughs A and B and the upstream mid-frame area 290. Thus, two printhead passes are made transverse to the direction of media M movement while the leading edge of the media is located with the subtrough B region. After the second printhead pass with the media leading edge located in the subtrough B region, the media M is indexed in a large move, in the exemplary distance of about 123 steps, to position $M_5$. The previously described small step, large step procedure repeats within the subtrough C region and the subtrough D region until the media is moved into media position $M_6$. From this position the media may be advanced in the large move, small move process as previously described or may be moved in substantially equally spaced steps, for example, alternating 77 and 79 step moves. As one skilled in the art may recognize equidistant moves and steps are preferred since they produce fewer print defects. As previously described, depending upon the length of the media and after several sequential indexing moves, the trailing edge of the media M will pass an end-of-form flag or sensor 222. When this occurs, the print controller is signaled as to the position of the media trailing edge. Accordingly, an adjusting move is made to position the trailing edge of the media M into the nominally aligned position $M_{10}$. The trailing edge of the media in position $M_{10}$ is substantially equivalent to the leading edge position as previously described at $M_1$. The adjustment move may be made based on the known location of the nominally aligned position of subtrough A and the signaled position provided by the end-of-form flag so that the trailing edge may be positioned appropriately in the nominally aligned position within the upstream portion of subtrough A. At this position, the printhead 28 makes a move transverse to media feed so as to overspray and form an image on the trailing edge of the media M. It should also be noted that nearly all of the printhead nozzle rows may be utilized when the media is positioned at $M_{10}$ so as to overspray and completely form an image on the trailing edge of the media M. Following printing at position $M_{10}$ the media M is indexed in a small move to position $M_{11}$. The small move is about 33 steps or $^{3}/_{1200}{}^{ths}$ inch. It should also be noted that while nearly all of the printhead nozzle rows may be utilized when the media M is positioned at $M_{10}$ and $M_{11}$, the uppermost region of the printhead 28 disposed above the mid-frame structure 290 is not operated so as to inhibit ink from contaminating the mid-frame structure 290. From position $M_{11}$, a large move on the order of about 123 steps or $^{123}/_{1200}{}^{ths}$ inch is made to index the media to position $M_{12}$ once the media is positioned at $M_{12}$ in the subtrough B region, the media continues its small move, large move process so as to be positioned at two locations within each of subtrough A through subtrough D. These positions are depicted as positions $M_{13}$-$M_{17}$. Thus, the trailing edge receives overspray in a total of eight locations from subtrough A through subtrough D to insure a proper image is formed along the trailing edge in the eight pass print mode.

Figure 21:
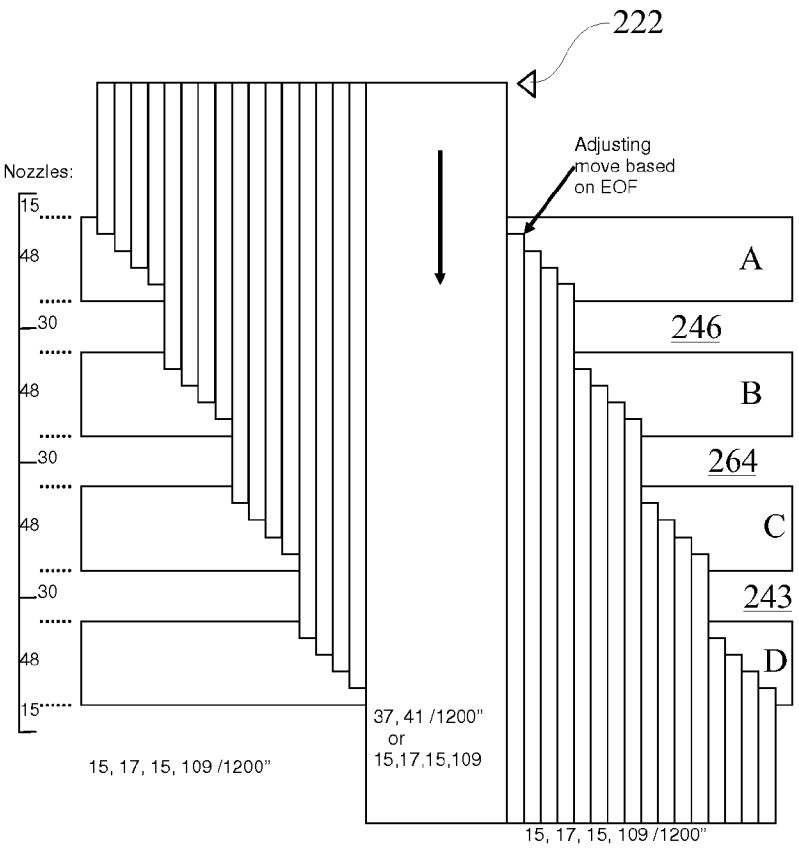
FIG. 21 is a top schematic view depicting a plurality of movements of a media having a leading edge and trailing edge across an ink trough in a sixteen-pass print mode.

Referring now to FIG. 21, a top schematic view of a 16 pass mode is depicted. In the 16 pass mode, the leading edge and trailing edge of the media M are each printed upon at four locations within each of the subtroughs A through D. Thus, at least 32 print steps occur corresponding to printing positions of the leading edge and trailing edge of media together. As previously described, once the media leading edge passes the subtrough D, the medium M may be advanced with substantially equivalent steps or a pattern of small and large steps. In the exemplary embodiment, the media M is moved from an upstream position of each subtrough, a move sequence of about 15, 17, and 15 steps followed by a large move of 109 steps in order to advance the media to the next subsequent subtrough. Within the middle portion of the media M wherein the leading edge is moved beyond subtrough D, the same pattern may be utilized or two or more larger steps which are substantially equivalent may be utilized. Further, as previously described, when the trailing edge of the media M passes the end-of-form flag 222, the trailing edge is advanced into a first position within the subtrough A which corresponds to the nominally aligned position of the leading edge, followed by the previously described indexing steps of, for example, 15, 17, 15, and 109 step moves.

Figure 23:
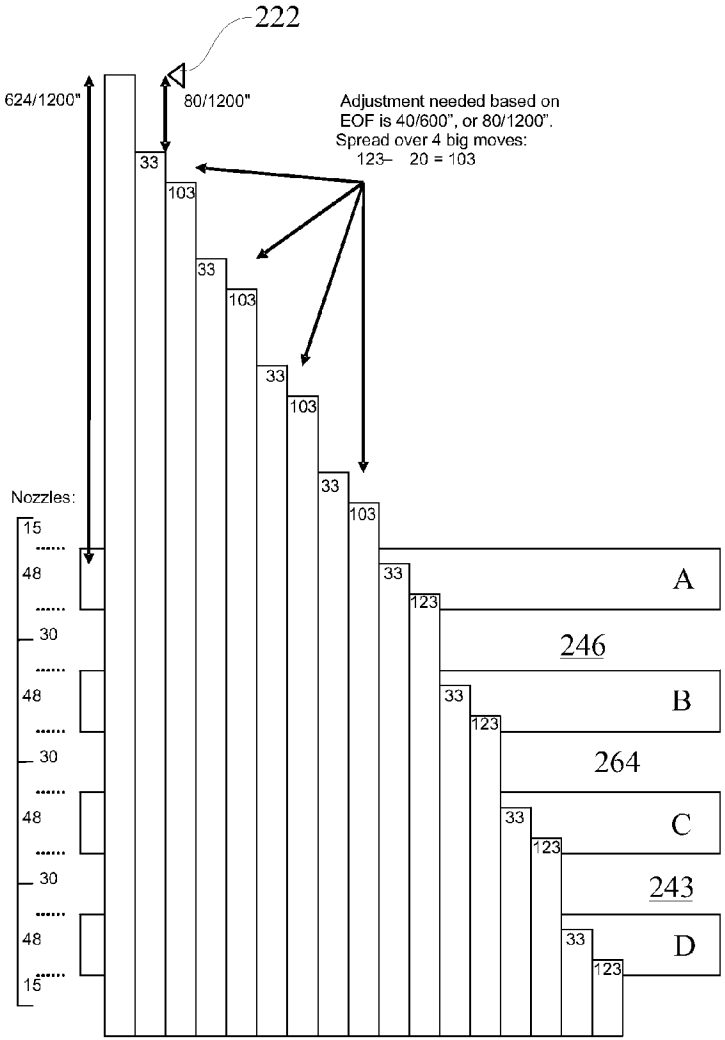
FIG. 23 is a top schematic view of media trailing edges moving across a plurality of subtroughs including an adjustment move.
Figure 22:
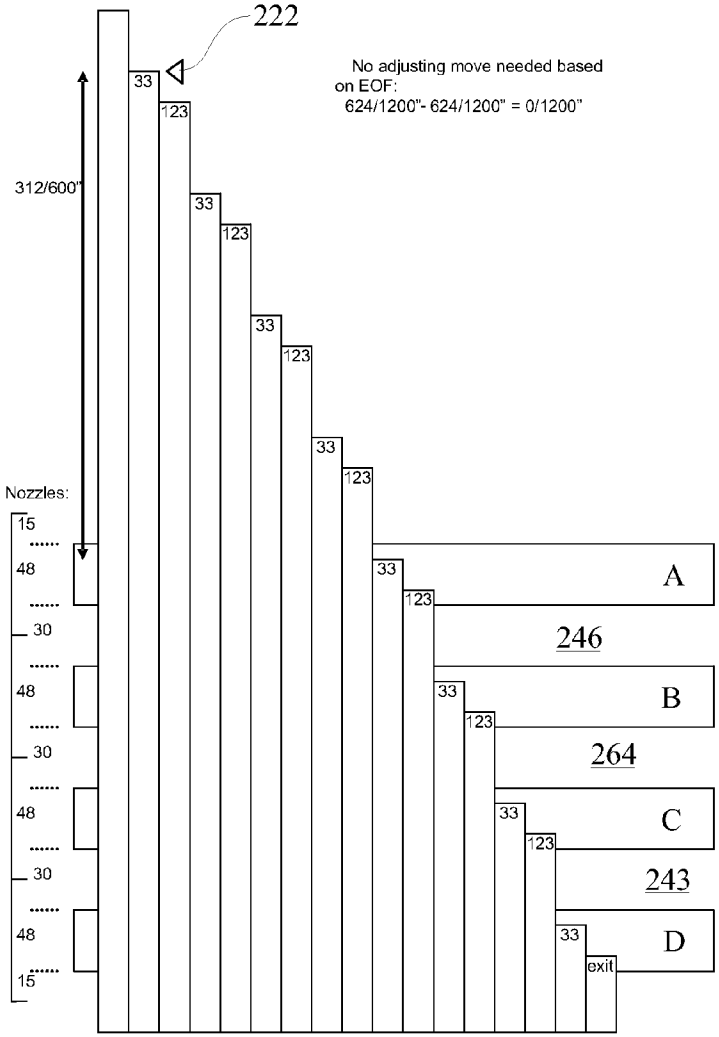
FIG. 22 is a top schematic view of media trailing edges moving across a plurality of subtroughs without an adjustment move.

Referring now to FIGS. 22 and 23, two schematic views of media feed are shown to depict the situation when adjustment is required to move the trailing edge of media M to a nominally aligned position within subtrough A. In the exemplary process, an eight pass print mode is depicted and moved from an initial trailing edge position through various positions above trough 230. In FIG. 22, the end of form sensor 222 signals the print controller (not shown), which according to the examples, determines that the trailing edge will reach the nominally aligned position without adjustment. Therefore, as previously discussed, the media is indexed so that that trailing edge moves in large steps of $^{123}/_{1200}{}^{ths}$ inch and small steps of $^{33}/_{1200}{}^{ths}$ inch until the trailing edge reaches the subtrough A. Alternatively, FIG. 23 depicts the condition, of an eight-pass print mode, where the trailing edge of media M is offset downwardly by $^{80}/_{1200}{}^{ths}$ inch from the starting position shown in FIG. 22. In order to position the trailing edge in the aligned position at subtrough A an adjustment is made and the $^{80}/_{1200}{}^{ths}$ inch is evenly divided by the four steps used to move the media M to subtrough A. Accordingly, $^{20}/_{1200}{}^{ths}$ inch are removed from each of the large steps so that a move of $^{103}/_{1200}{}^{ths}$ inch is made until the media trailing edge reaches the nominally alignes position in subtrough A.

Figure 24:
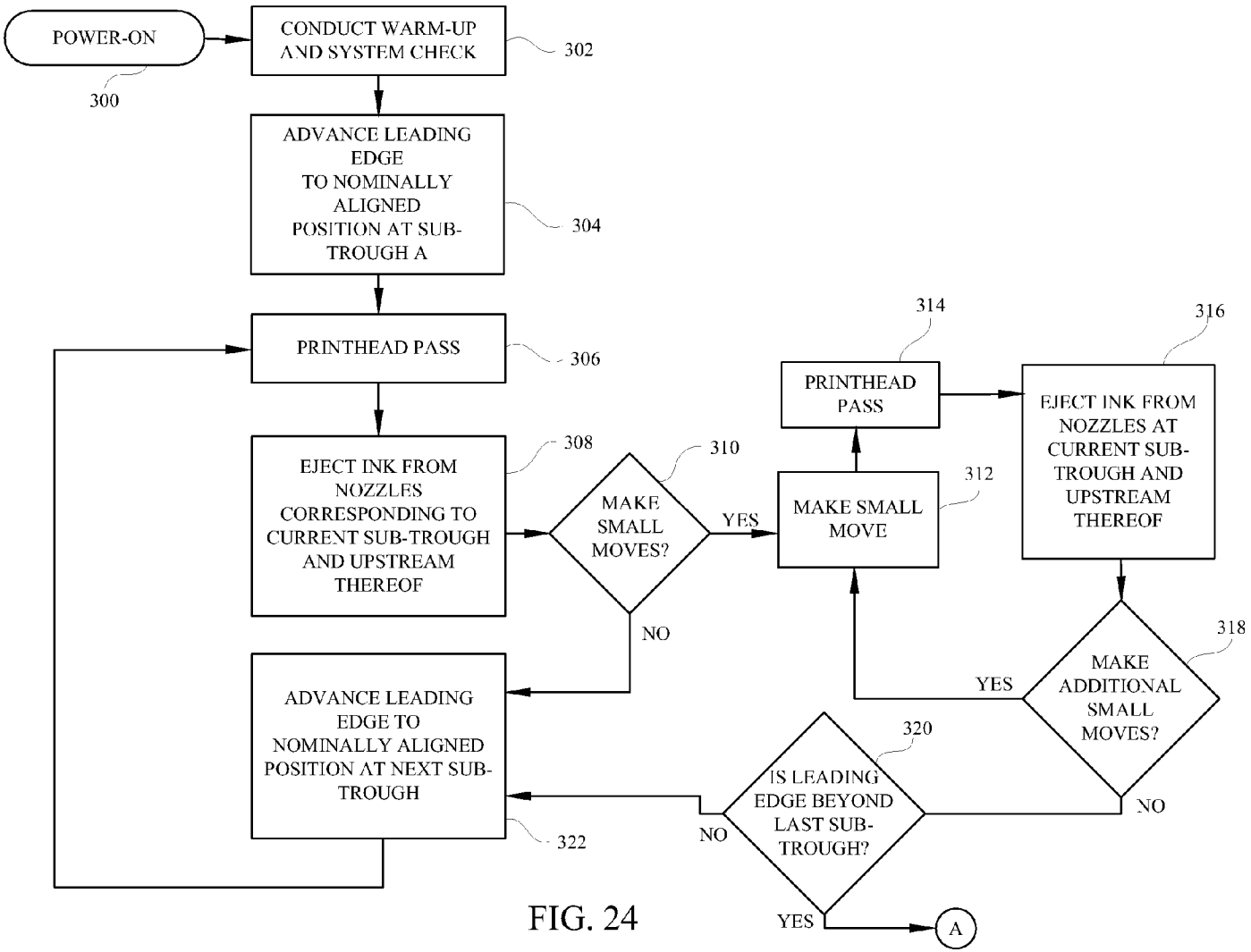
FIG. 24 is a flow chart depicting the method of the present invention.

Referring not to FIG. 24, a flow chart is shown depicting operation of the media indexing to inhibit ink mist from contaminating adjacent support ribs. Initially, the device 10 is powered on at 300. After a warm-up period and system check by a print controller at 302, the leading edge of a medium M is advanced to a nominally aligned position at subtrough A at 304.

When the media is positioned at the nominally aligned position of subtrough A at 304, the printhead 28 makes a printing pass at 306. During this printhead pass, ink nozzles eject ink at 308 only corresponding to the subtrough A and those upstream thereof, such as those over mid-frame 290.

Next, the print controller must make a decision based on whether the printer is being operated in 4 pass print mode, 8 pass print mode, 16 pass print mode or some other mode. Such selection may be input as a selection upon making the print request at the user's computer or on-board the printer at control panel 11. As previously mentioned, the higher the number of passes the higher the print quality. For purpose of the exemplary description an eight pass print mode is described. Thus, in an eight pass print mode the print controller decides whether small moves within each subtrough is necessary at 310. As previously shown and described, the situation of an eight pass print mode, one small move is required within each subtrough and media M is indexed a small move at 312. Following the small move at 312, the printhead 28 makes a pass at 314 during which time the media M is located at position $M_2$ of FIG. 20.

During the printhead pass at 314, ink is ejected from the printhead nozzles corresponding to subtrough A at 316. After this printing pass, the print controller must decide whether additional moves are necessary at 318. In the exemplary embodiment of an eight pass print mode, the answer is no. However, in 16 pass or other print modes where the answer is yes, a loop is made through process steps 312, 314, and 316 until reaching decision 318. When the answer to decision 318 is no, the print controller must decide whether the leading edge is beyond the last subtrough D at 320. This may be determined with a form flag or sensor (not shown). If the answer is no, the media leading edge is advanced to a nominally aligned position at the next subsequent subtrough, in the exemplary embodiment subtrough B, at position 322. From position 322, the process repeats by looping to printhead pass 306. The process loops for the leading edge of the media at each subsequent subtrough B, C and D.

Figure 25:
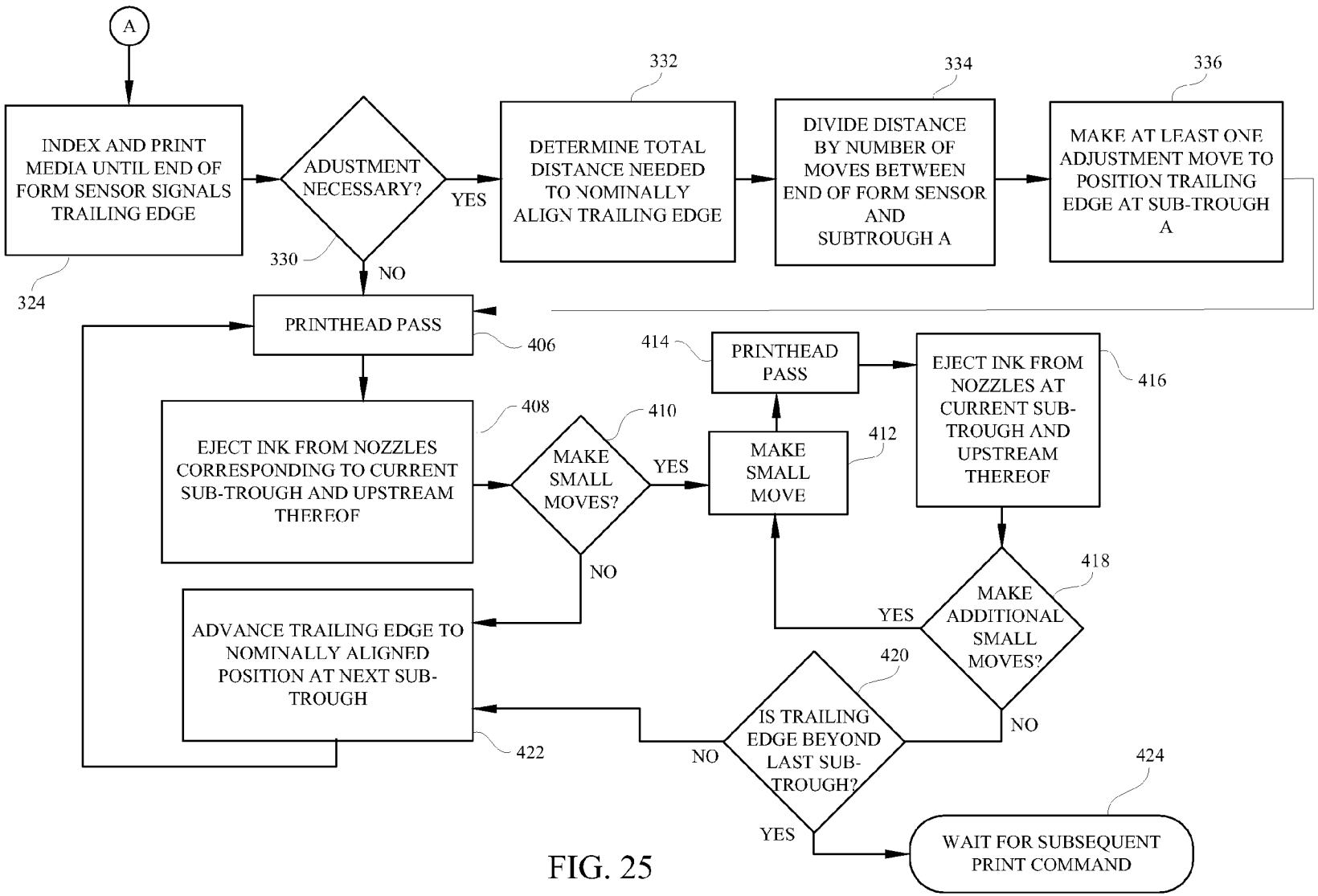
FIG. 25 is a flow chart continuing the method depicted in FIG. 24.

When the answer to decision at 320 is yes, the leading edge is spaced beyond that last subtrough D, the media M is indexed in equal steps and printed upon until the end-of-form sensor signals to the print controller that the trailing edge has reached that position at 324 as shown from FIGS. 24-25. Once such signal occurs the print controller decides whether adjustment is necessary to position the trailing edge of media M at the nominally aligned position of subtrough A at 330. If the print controller determines that no adjustment is need, the process continues at 406 with a printing pass. If the print controller determines that some adjustment is necessary at 330, the print controller next determines the total distance needed to nominally align the trailing edge at 332. After the adjustment difference is ascertained, the print controller divides the total distance by the number of moves between the current trailing edge position and nominally aligned position of subtrough A at 334. The number of moves may be the large moves, small moves, or both. The distance per step is then accounted for in at least one adjustment move at 336 which positions the trailing edge at subtrough A. The process then continues at 406 with a printing pass being made. Subsequent actions at 408, 410, 412, 414, 416, 418, 420, 422 with respect to trailing edge of the media are substantially the same as those described for the actions at 308-322 done with respect to the leading edge of the media. At decision 420 when the trailing edge is beyond the last sub-trough the printing on the media is completed and the process at 424 waits for a subsequent print command.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for improved edge-to-edge printing on media in a printer having a printhead disposed above an ink trough, said ink trough having a plurality of sections formed by a plurality of trough support ribs within said ink trough comprising:

indexing a leading edge of media to a first position over a first trough section;

selectively operating printhead jets which are positioned above said media to inhibit ink contamination of exposed support ribs;

indexing said media leading edge to one of a second position within said first trough section or a position within a second trough section, wherein the indexing comprises a large move to each of the trough sections and a small move within each of the trough sections; and selectively operating printhead jets corresponding to said one of said second position within said first trough section or said position within said second trough section.

2. The method of claim 1 further comprising indexing said media leading edge to each of said plurality of trough sections.

3. The method of claim 2 further comprising indexing a trailing edge of said media to at least one position within said plurality of trough sections.

4. The method of claim 1 further comprising indexing said media leading edge to at least two positions within each of said trough sections.

5. The method of claim 1 further comprising increasing the number of active printhead nozzles through each subsequent indexing of said media leading edge through each of said trough sections.

6. The method of claim 5 further comprising decreasing the number of active printhead nozzles as a media trailing edge is indexed through each of said trough sections.

7. The method of claim 1 further comprising indexing a trailing edge of said media through two positions within each of said trough sections.

8. The method of claim 1 further comprising indexing steps of substantially equivalent distance when said leading edge is beyond a final of said plurality of trough sections and said trailing edge has not reached an end of form sensor.

9. The method of claim 1, further comprising:

detecting when a trailing edge of said media is detected;

determining whether an adjustment move is needed to position the trailing edge in a nominally aligned position;

making one or more adjustment moves to nominally align said trailing edge; and indexing said trailing edge to at least one third position within said plurality of trough sections.

10. The method of claim 9, further comprising:

forming an image along said trailing edge of said media at said at least one third position within said plurality of trough sections.

11. The method of claim 1, further comprising:

indexing a trailing edge of said media to at least one third position within said plurality of trough sections; and forming an image along said trailing edge of said media at said at least one third position within said plurality of trough sections.

12. The method of claim 11, further comprising:

prior to indexing a trailing edge of said media, determining whether an adjustment move is needed to position said trailing edge in a nominally aligned position; and making one or more adjustment moves to nominally align said trailing edge.

13. A method for improved edge-to-edge printing on media in a printer having a printhead disposed above an ink trough, said ink trough having a plurality of sections formed by a plurality of trough support ribs within said ink trough comprising:

indexing a leading edge of media to a first position over a first trough section;

selectively operating printhead ink nozzles which are positioned above said media;

indexing said media leading edge to one of a second position within said first trough section or a position within a second trough section;

selectively operating printhead ink nozzles corresponding to said one of said second position within said first trough section or said position within said second trough section;

detecting when a trailing edge of said media is detected;

determining whether an adjustment move is needed to position the trailing edge in a nominally aligned position;

making one or more adjustment moves to nominally align said trailing edge; and indexing said trailing edge to at least one third position within said plurality of trough sections.

14. The method of claim 13 further comprising increasing the number of active printhead ink nozzles through each subsequent indexing of said media leading edge through each section of said ink trough.

15. The method of claim 13 further comprising indexing a large move to each section of said ink trough and at least one small move within each section of said ink trough.

16. The method of claim 13, further comprising indexing of substantially equivalent distance when said leading edge is beyond a final of said plurality of sections of said ink trough and said trailing edge has not reached an end of form sensor.

17. A method for improved edge-to-edge printing on media in a printer having a printhead disposed above an ink trough, said ink trough having a plurality of sections formed by a plurality of trough support ribs within said ink trough comprising:

indexing a leading edge of media to a first position over a first trough section;

selectively operating printhead ink nozzles which are positioned above said media;

indexing said media leading edge to one of a second position within said first trough section or a position within a second trough section, wherein the indexing comprises a large move to each of the trough sections and a small move within each of the trough sections and indexing said media leading edge through each of said trough sections causes an increase in the number of active printhead nozzles;

selectively operating printhead ink nozzles corresponding to said one of said second position within said first trough section or said position within said second trough section;

indexing a trailing edge of said media to at least one third position within said plurality of trough sections; and selectively operating printhead ink nozzles along said trailing edge of said media at said at least one third position within said plurality of trough sections.

18. A method for improved edge-to-edge printing on media in a printer having a printhead disposed above an ink trough, said ink trough having a plurality of sections formed by a plurality of trough support ribs within said ink trough comprising:

indexing a leading edge of media to a first position over a first trough section;

selectively operating printhead jets which are positioned above said media to inhibit ink contamination of exposed support ribs;

indexing said media leading edge to one of a second position within said first trough section or a position within a second trough section; and selectively operating printhead jets corresponding to said one of said second position within said first trough section or said position within said second trough section, wherein the step of indexing further comprising indexing a large move to each of said trough sections and small move within each of said trough sections.

19. The method of claim 18 further comprising indexing said media leading edge to at least two positions within each of said trough sections.

20. The method of claim 19 further comprising indexing a trailing edge of said media to at least one position within said plurality of trough sections.

21. The method of claim 18 further comprising indexing said media leading edge to each of said plurality of trough sections.

22. A method for improved edge-to-edge printing on media in a printer having a printhead disposed above an ink trough, said ink trough having a plurality of sections formed by a plurality of trough support ribs within said ink trough comprising:

indexing a leading edge of media to first position over a first trough section;

selectively operating printhead jets which are positioned above said media to inhibit ink contamination of exposed support ribs;

indexing said media leading edge to one of a second position within said first trough section or a position within a second trough section; and selectively operating printhead jets corresponding to said one of said second position within said first trough section or said position within said second trough section, wherein the step of selectively operating printhead jets further comprising:

increasing the number of active printhead nozzles through each subsequent indexing of said media leading edge through each of said trough sections; and indexing a large move to each of said trough sections and at least one small move within each of said trough sections.

* * * * *